US010581133B2

(12) United States Patent
Santoniccolo et al.

(10) Patent No.: US 10,581,133 B2
(45) Date of Patent: Mar. 3, 2020

(54) RESONANT CAVITY FILTERS WITH HIGH PERFORMANCE TUNING SCREWS

(71) Applicant: CommScope Italy S.r.l., Agrate Brianza (IT)

(72) Inventors: Marco Santoniccolo, Milan (IT); Stefano Galli, Magenta (IT); Giuseppe Resnati, Seregno (IT)

(73) Assignee: CommScope Italy, S.r.l. (IT)

( * ) Notice: Subject to any disclaimer, the term of this patent is extended or adjusted under 35 U.S.C. 154(b) by 175 days.

(21) Appl. No.: 15/736,097

(22) PCT Filed: Jul. 5, 2016

(86) PCT No.: PCT/EP2016/065798

§ 371 (c)(1),
(2) Date: Dec. 13, 2017

(87) PCT Pub. No.: WO2017/005731

PCT Pub. Date: Jan. 12, 2017

(65) Prior Publication Data

US 2018/0358674 A1 Dec. 13, 2018

Related U.S. Application Data

(60) Provisional application No. 62/188,795, filed on Jul. 6, 2015.

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/208* (2013.01); *H01P 1/2136* (2013.01); *H01P 7/04* (2013.01); *H01P 7/06* (2013.01)

(58) Field of Classification Search
CPC .. H01P 1/208; H01P 7/06; H01P 1/207; H01P 1/2136; H01P 1/2053; H01P 7/04
(Continued)

(56) References Cited

U.S. PATENT DOCUMENTS 3,605,041 A 9/1971 Judkins
6,384,699 B1 5/2002 Henningsson et al.
(Continued)

FOREIGN PATENT DOCUMENTS

DE 10 2005 012 375 A1 12/2005
GB 827760 2/1960

OTHER PUBLICATIONS

Machine English Translation of DE102005012375A1, Published on Dec. 2005 (Year: 2005).*
(Continued)

*Primary Examiner* — Rakesh B Patel
*Assistant Examiner* — Jorge L Salazar, Jr.
(74) *Attorney, Agent, or Firm* — Myers Bigel, P.A.

(57) ABSTRACT

A resonant cavity filter has a housing having a resonator mounted therein, a tuning screw that comprises a head portion, a metallic tuning element and a dielectric spacer interposed between the head portion and the metallic tuning element. The tuning screw is mounted for coaxial insertion into an interior of the resonator to adjust a frequency response of the resonant cavity filter.

20 Claims, 16 Drawing Sheets

(51) Int. Cl.
*H01P 1/208* (2006.01)
*H01P 1/213* (2006.01)
*H01P 7/06* (2006.01)

(58) Field of Classification Search
USPC ..... 333/202, 203, 206, 207, 222, 223, 224, 333/225, 226
See application file for complete search history.

(56) References Cited

U.S. PATENT DOCUMENTS

| | | | | |
|---|---|---|---|---|
| 7,078,990 | B1 | 7/2006 | Patel et al. | |
| 8,947,179 | B2 | 2/2015 | Haunberger et al. | |
| 2014/0132372 | A1* | 5/2014 | Wiehler ..... | H01P 1/205 333/207 |

OTHER PUBLICATIONS

Notification Concerning Transmittal of International Preliminary Report on Patentability, for corresponding International Application PCT/EP2016/065798, dated Jan. 18, 2019.
International Search Report and Written Opinion of the International Searching Authority, PCT Application No. PCT/EP2016/065798, dated Sep. 30, 2016, 16 pp.

* cited by examiner

RESONANT CAVITY FILTERS WITH HIGH PERFORMANCE TUNING SCREWS

CROSS-REFERENCE TO RELATED APPLICATIONS

The present application is a 35 U.S.C. § 371 national stage application of PCT International Application Serial No. PCT/EP2016/065798, filed on Jul. 5, 2016, which itself claims priority under 35 U.S.C. § 119 to U.S. Provisional Patent Application Ser. No. 62/188,795, filed Jul. 6, 2015, the entire contents of both of which are incorporated herein by reference. The above-referenced PCT International Application was published in the English language as International Publication No. WO 2017/005731 A1 on Jan. 12, 2017.

FIELD OF THE INVENTION

The present invention relates generally to communications systems and, more particularly, to filters that are suitable for use in cellular communications systems.

BACKGROUND

Cellular base stations are well known in the art and typically include, among other things, baseband equipment, radios and antennas. FIG. 1 is a highly simplified, schematic diagram that illustrates a conventional cellular base station 10. As shown in FIG. 1, the cellular base station 10 includes an antenna tower 30 and an equipment enclosure 20 that is located at the base of the antenna tower 30. A plurality of baseband units 22 and radios 24 are located within the equipment enclosure 20. Each baseband unit 22 is connected to a respective one of the radios 24 and is also in communication with a backhaul communications system 44. Three sectorized antennas 32 (labelled antennas 32-1, 32-2, 32-3) are located at the top of the antenna tower 30. Three coaxial cables 34 (which are bundled together in FIG. 1 to appear as a single cable) connect the radios 24 to the respective antennas 32. In many cases the radios 24 are located at the top of the tower 30 instead of in the equipment enclosure 20 in order to reduce signal transmission losses.

Cellular base stations often use phased array antennas 32 that comprise a linear array of radiating elements. Typically, each radiating element is used to (1) transmit radio frequency ("RF") signals that are received from a transmit port of an associated radio 24 and (2) receive RF signals from mobile users and pass these received signals to the receive port of the associated radio 24. Duplexers are typically used to connect the radio 24 to each respective radiating element of the antenna 32. A "duplexer" refers to a well-known type of three-port filter assembly that is used to connect both the transmit and receive ports of a radio 24 to an antenna 32 or to one or more radiating elements of multi-element antenna 32. Duplexers are used to isolate the RF transmission paths to the transmit and receive ports of the radio 24 from each other while allowing both RF transmission paths access to the radiating element(s) of the antenna 32.

FIG. 2 is a perspective view of a conventional duplexer 50. FIG. 3 is a perspective view of the conventional duplexer 50 of FIG. 2 with the cover plate removed therefrom. FIG. 4 is a perspective view of the duplexer 50 of FIGS. 2-3 with the top cover and resonators removed to more clearly show the cavities within the filter housing.

Referring to FIGS. 2-4, the conventional duplexer 50 includes a housing 60 that has a floor 62 and a plurality of sidewalls 64. An interior ledge 66 is formed around the periphery of the housing 60. Internal walls 68 extend upwardly from the floor 62 to divide the interior of the housing 60 into a plurality of cavities 70. Coupling windows 72 are formed within the walls 68, and these windows 72 as well as openings between the walls 68 allow communication between the cavities 70. Internally-threaded columns 74 and resonating elements 76 are provided within the housing 60. The resonating elements 76 may comprise, for example, dielectric resonators or coaxial metal resonators, and may be mounted onto selected ones of the internally threaded cavities 74. A cover plate 78 acts as a top cover for the duplexer 50. Screws 80 are used to tightly hold the cover plate 78 into place so that the cover plate 78 continuously contacts the interior ledge 66 and the top surfaces of the walls 68.

The duplexer 50 further includes an input port 82, an output port 84 and a common port 86. The input port 82 may be attached to an output port of a transmit path phase shifter (not shown) via a first cabling connection 83. The output port 84 may be attached to an input port of a receive path phase shifter via a second cabling connection 85. The common port 86 may connect the duplexer 50 to a radiating element of the antenna (not shown) via a third cabling connection (not shown). A plurality of tuning screws 90 are also provided. The tuning screws 90 may be adjusted to tune aspects of the frequency response of the duplexer 50 such as, for example, the center frequency of the notch in the filter response. It should be noted that the device of FIGS. 2-4 comprises two duplexers that share a common housing, which is why the device includes more than three ports (the device includes a total of six ports, although all of the ports are not visible in the views of FIGS. 2-4).

FIGS. 5A and 5B are perspective views of conventional tuning screws shown mounted in top covers of respective filters. Referring first to FIG. 5A, a tuning screw 100 is shown mounted in a top cover 120 of a filter housing. The top cover 120 has a plurality of apertures 130 extending therethrough (two apertures 130 are depicted in FIG. 5A, one of which has the tuning screw 100 inserted therein). A threaded nut 140 may be soldered above each aperture 130. Tuning screws 100 are threaded through the respective threaded nuts 140 to extend into the respective apertures 130 Only one tuning screw 100 is shown). The tuning screws 100 can readily be threaded further into and further out of the threaded nuts 140, and hence into and out of the cavity of the filter, and therefore may facilitate very precise tuning of the filter. While not shown, in other embodiments a thicker top cover 120 may be used that has threaded apertures formed therein which may eliminate the need for separate threaded nuts 140.

Referring to FIG. 5B, a cover 170 of a filter housing is depicted that includes a self-locking tuning screw 150 mounted therein. The self-locking tuning screw 150 is mounted in a threaded aperture 180 in the cover 170 (a second threaded aperture 180 is illustrated in FIG. 5B that does not have a tuning screw 150 therein). The self-locking tuning screw 150 may operate in the same fashion as the tuning screw 100 discussed above.

DETAILED DESCRIPTION

Figure 1:
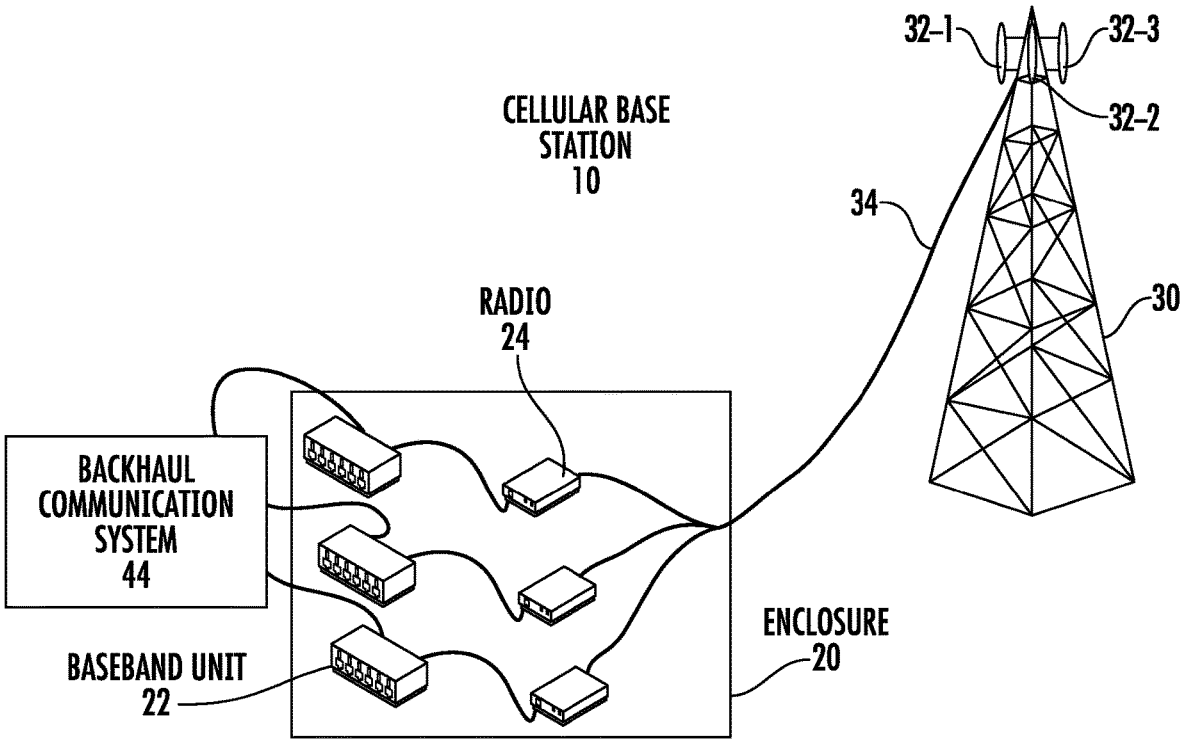
FIG. 1 (PRIOR ART)
FIG. 1 is a highly simplified, schematic diagram of a conventional cellular base station.
Figure 2:
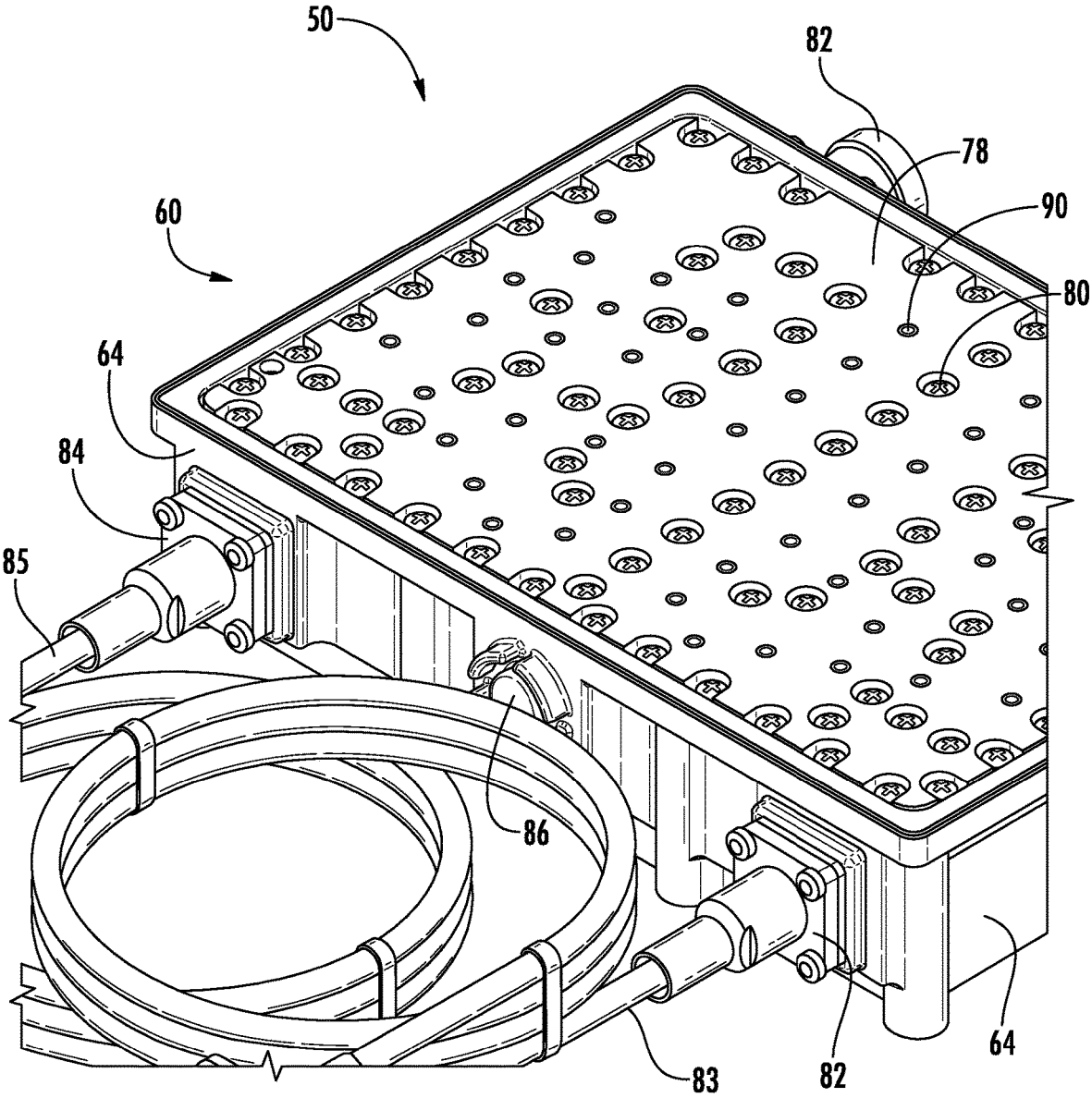
FIG. 2 (PRIOR ART)
FIG. 2 is a perspective view of a conventional duplexer.
Figure 3:
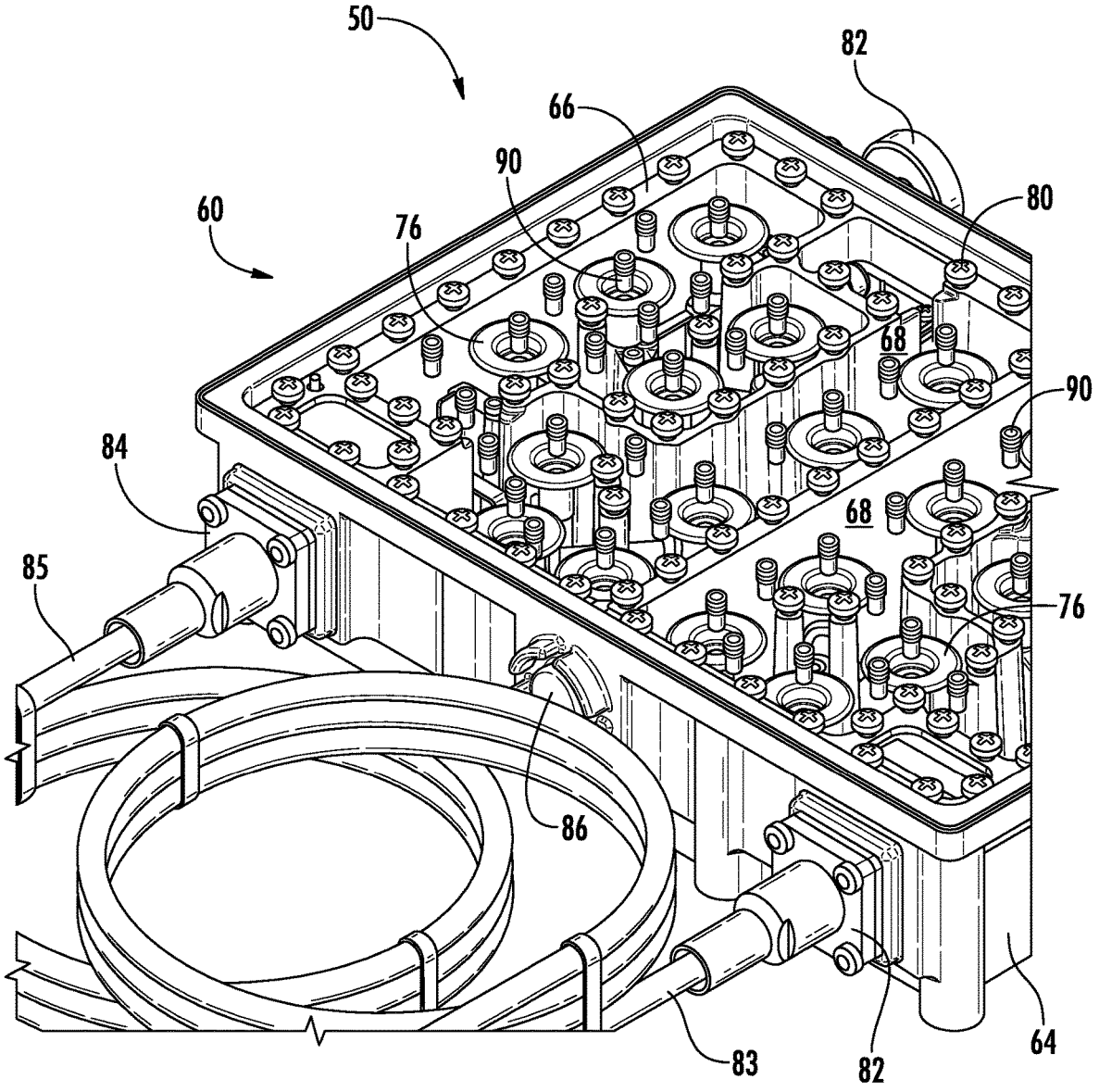
FIG. 3 (PRIOR ART)
FIG. 3 is a perspective view of the conventional duplexer of FIG. 2 with the cover plate removed therefrom.
Figure 4:
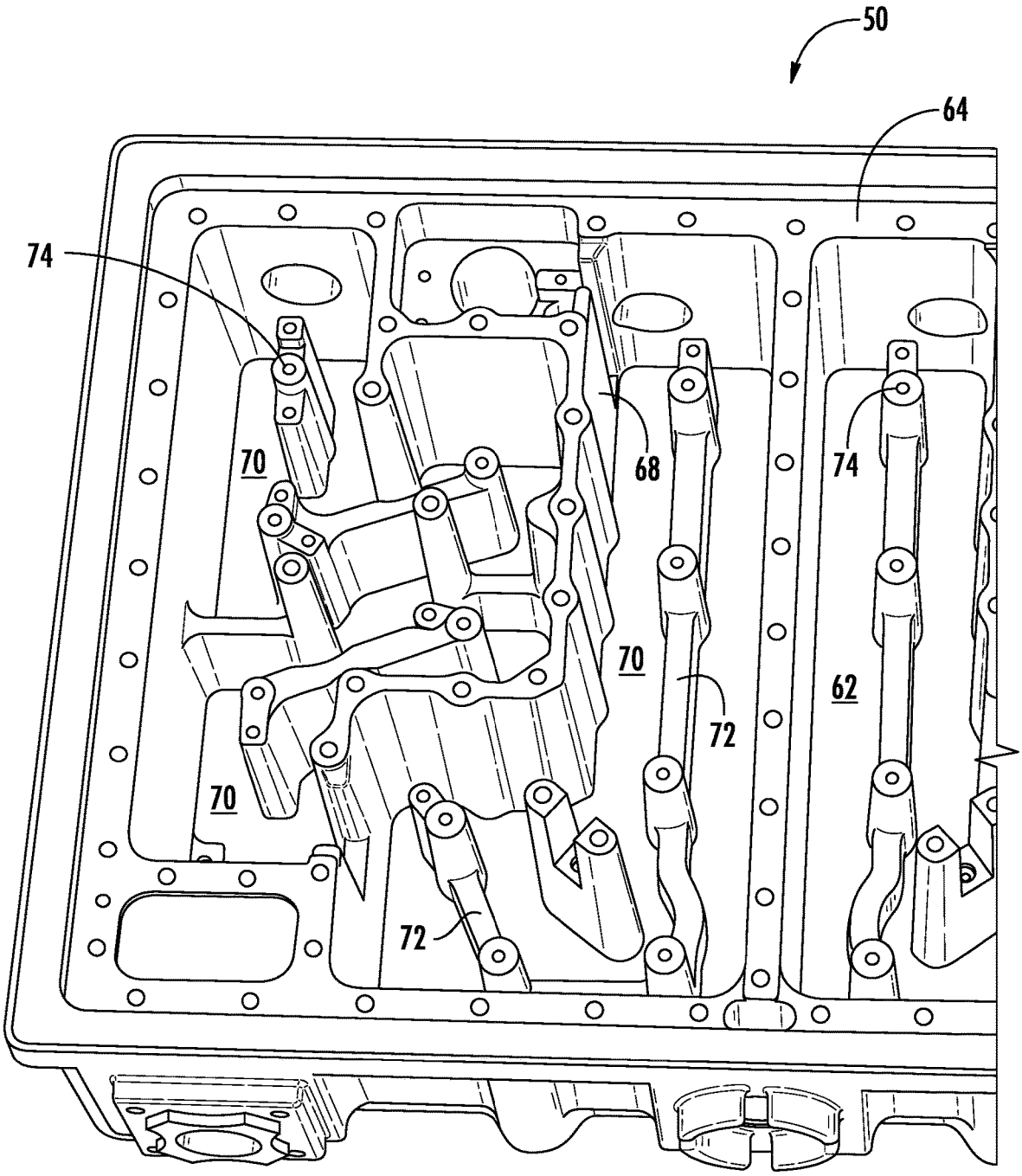
FIG. 4 (PRIOR ART)
FIG. 4 is a perspective view of the duplexer of FIGS. 2-3 with the top cover and resonators removed.
Figure 5A:
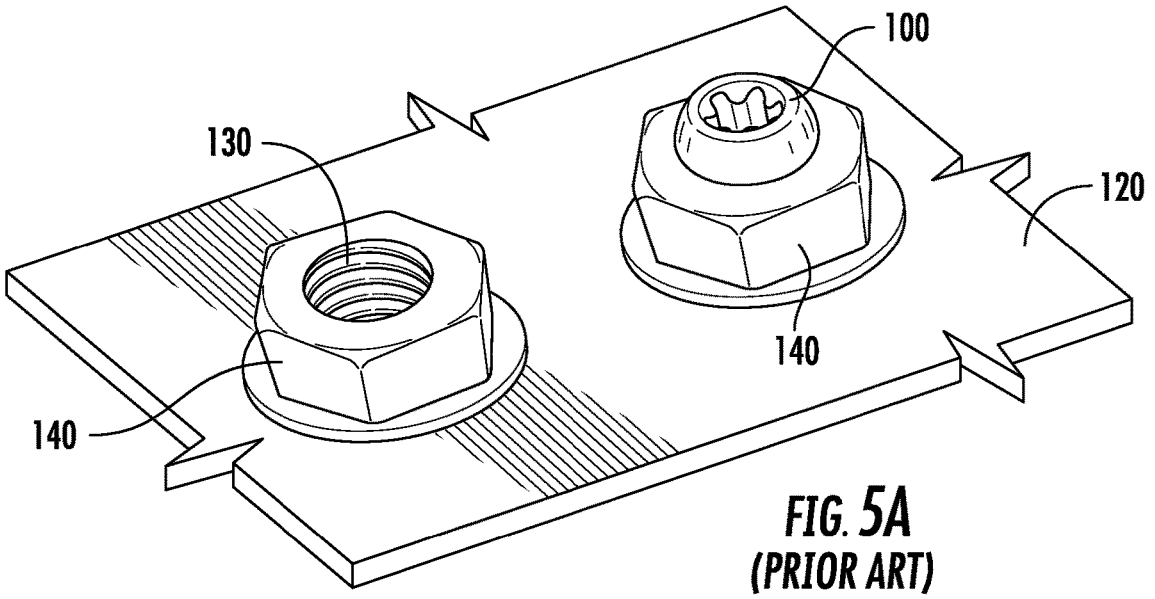
FIG. 5A (PRIOR ART)
FIGS. 5A-5B are perspective views of a conventional tuning screw and a conventional self-locking tuning screw, respectively.
Figure 5B:
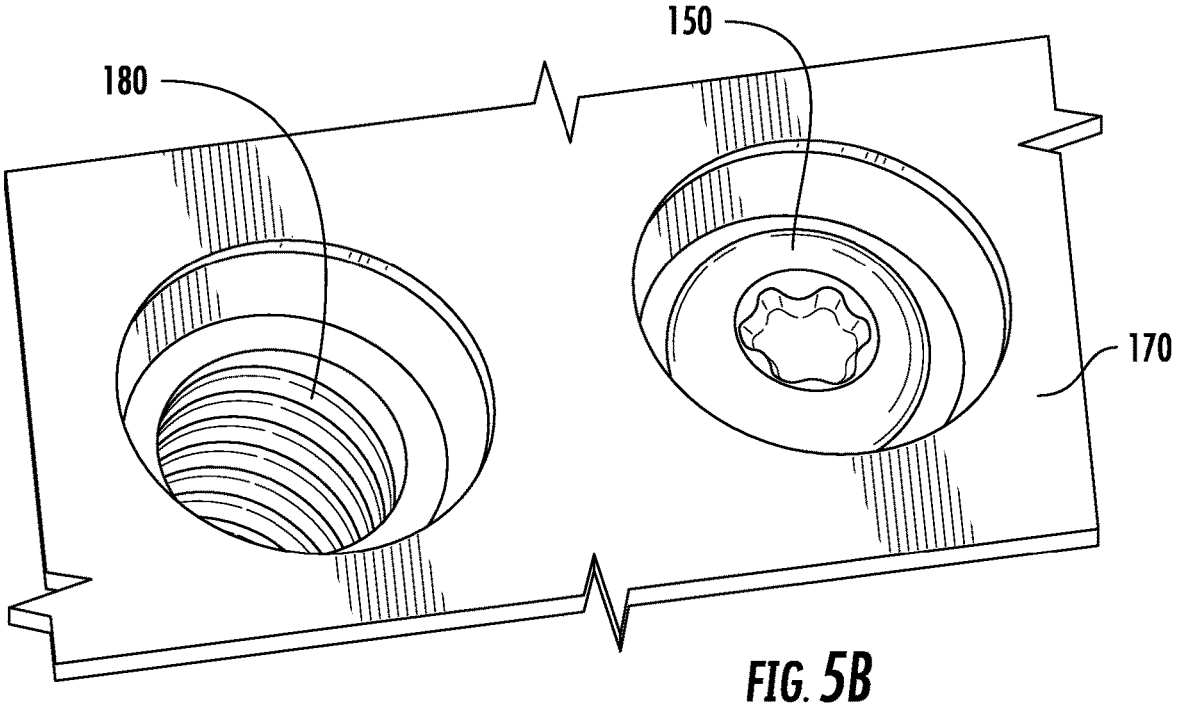
FIG. 5B (PRIOR ART)

Passive Intermodulation ("PIM") distortion is a well known effect that may occur when multiple RF signals are transmitted through a communications system. As is known in the art, PIM distortion may occur when two or more RF signals encounter non-linear electrical junctions or materials along an RF transmission path. Such non-linearities may act like a mixer causing new RF signals to be generated at mathematical combinations of the original RF signals. If the newly generated RF signals fall within the bandwidth of existing RF signals, the noise level experienced by those existing RF signals is effectively increased. When the noise level is increased, it may be necessary reduce the data rate and/or the quality of service. PIM distortion can be an important interconnection quality characteristic for an RF communications system, as PIM distortion generated by a single low quality interconnection may degrade the electrical performance of the entire RF communications system. Thus, ensuring that components used in RF communications systems will generate acceptably low levels of PIM distortion may be desirable.

One possible source of PIM distortion is an inconsistent metal-to-metal contact along an RF transmission path. Conventional tuning screws for resonant cavity filters form metal-to-metal contacts where the metal screws are threaded into a mating metallic nut of the filter housing. Moreover, tuning screws typically are not driven all the way into their mating nut such that they can be very tightly received therein, as the whole point of tuning screws is to provide a method of adjusting the frequency response of the filter in a desired fashion based on the depth to which the screw is inserted within the filter cavity. As such, the tuning screws of a resonant cavity filter may form inconsistent metal-to-metal contacts with their respective mating nuts that may generate PIM distortion.

Pursuant to embodiments of the present invention, resonant cavity filters are provided that have improved tuning screws. The filters may be duplexers, diplexers, combiners or the like that are suitable for use in cellular communications systems and other applications. The filters may be designed so that the metal-to-metal contacts between the tuning screws and their respective nuts of the filter housing are effectively outside of the RF transmission path so that any inconsistent metal-to-metal contacts between the tuning screws and filter housing will give rise to little if any PIM distortion. The filters according to some embodiments of the present invention may also be designed so that metal shavings and/or metal debris that may be formed as the screws are threaded through their mating nuts are less likely to fall within the housing of the filter where such metal shavings/debris may give rise to PIM distortion. Thus, the resonant cavity filters according to embodiments of the present invention may provide improved PIM distortion performance as compared to conventional resonant cavity filters.

In some embodiments, the tuning screws may include a dielectric spacer that separates a metallic tuning element of the tuning screw from a head portion of the tuning screw. The dielectric spacer may substantially electrically isolate the head portion of the tuning screw from the tuning element, and hence may isolate any inconsistent metal-to-metal contacts between the tuning screw and a mating nut or bushing from the RF transmission path.

In some embodiments, the tuning screws may include internal threads that mate with external threads of a mating nut. Such a design moves the threaded connection between the tuning screw and mating nut away from the bore of the nut. This may help prevent any metal shavings or debris that may be cut from the tuning screw or nut when the tuning screw is adjusted from falling into the interior of the resonant cavity filter, where such metal shavings or debris otherwise might serve as a source of PIM distortion.

According to further embodiments of the present invention, tuning screws are provided that extend into the interior of the filter from the bottom of the filter. These tuning screws may include dielectric spacers that isolate the threaded connection from the RF transmission path. These tuning screws may also include a dielectric stopper that may act to reduce or prevent metal shavings or debris that may be generated when the tuning screw is adjusted from falling into the interior of the filter.

In some embodiments, the filter assemblies may comprise three port devices such as RF duplexers or diplexers. In other embodiments, these filter assemblies may include additional ports to implement multiplexers, triplexers, combiners or the like. The filters according to embodiments of the present invention may exhibit low insertion loss values and very low levels of PIM distortion.

Embodiments of the present invention will now be described in greater detail with reference to the attached drawings, in which example embodiments are depicted.

Figure 6:
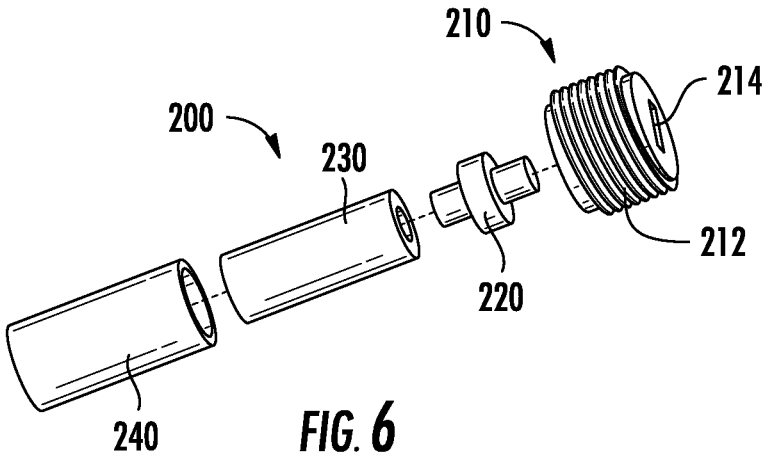
FIG. 6 is a perspective view of a tuning screw according to embodiments of the present invention.
Figure 7:
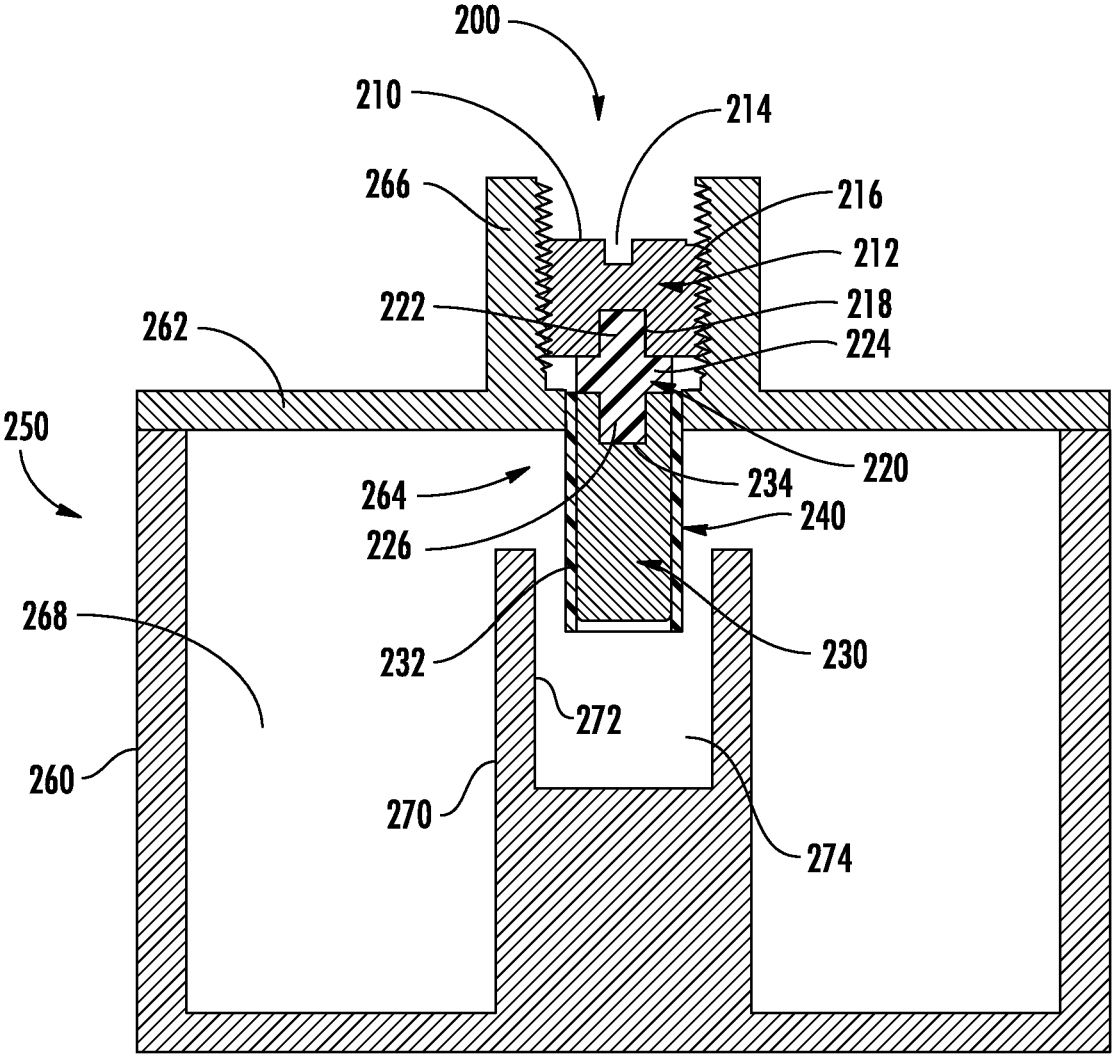
FIG. 7 is a schematic cross-sectional view of the tuning screw of FIG. 6 illustrating how it may be received within a coaxial resonator of a resonant cavity filter in order to tune the frequency response of the filter.
Figure 8:
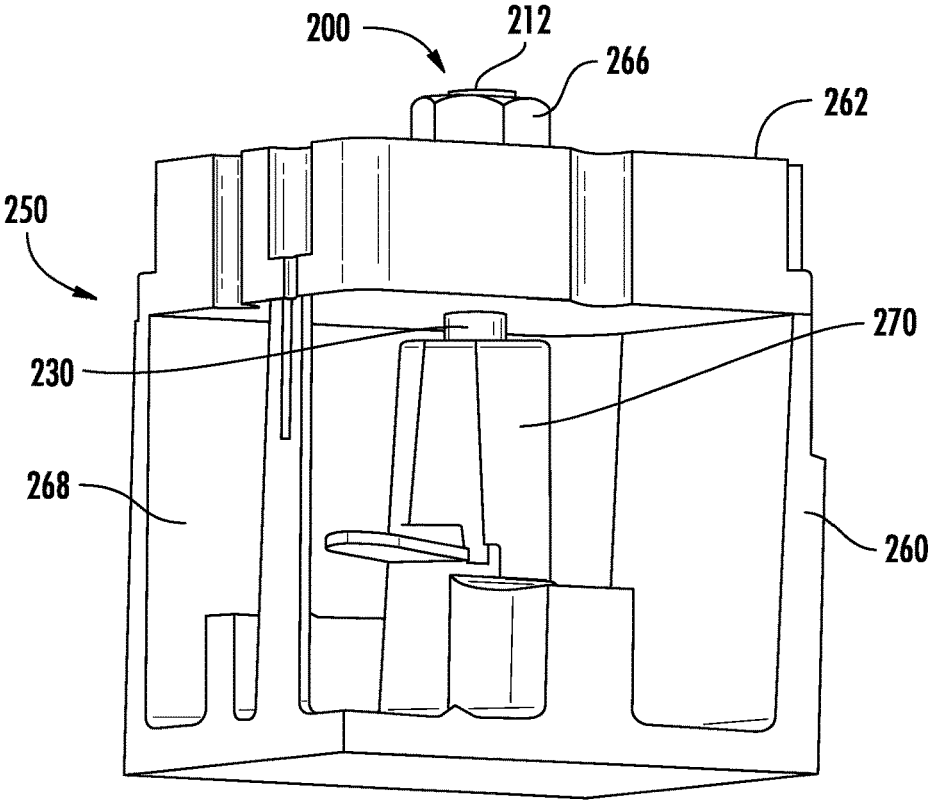
FIG. 8 is a broken-away, perspective view of a portion of a resonant cavity filter according to embodiments of the present invention that includes the tuning screw of FIG. 6.
Figure 9:
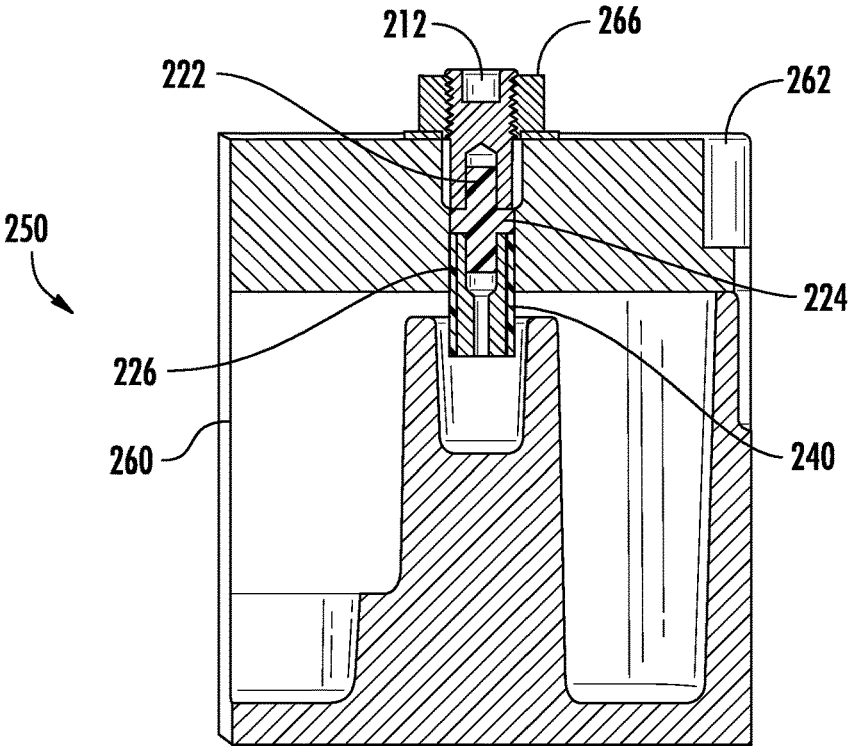
FIG. 9 is a cross-sectional view of a portion of the resonant cavity filter of FIG. 8
Figure 10:
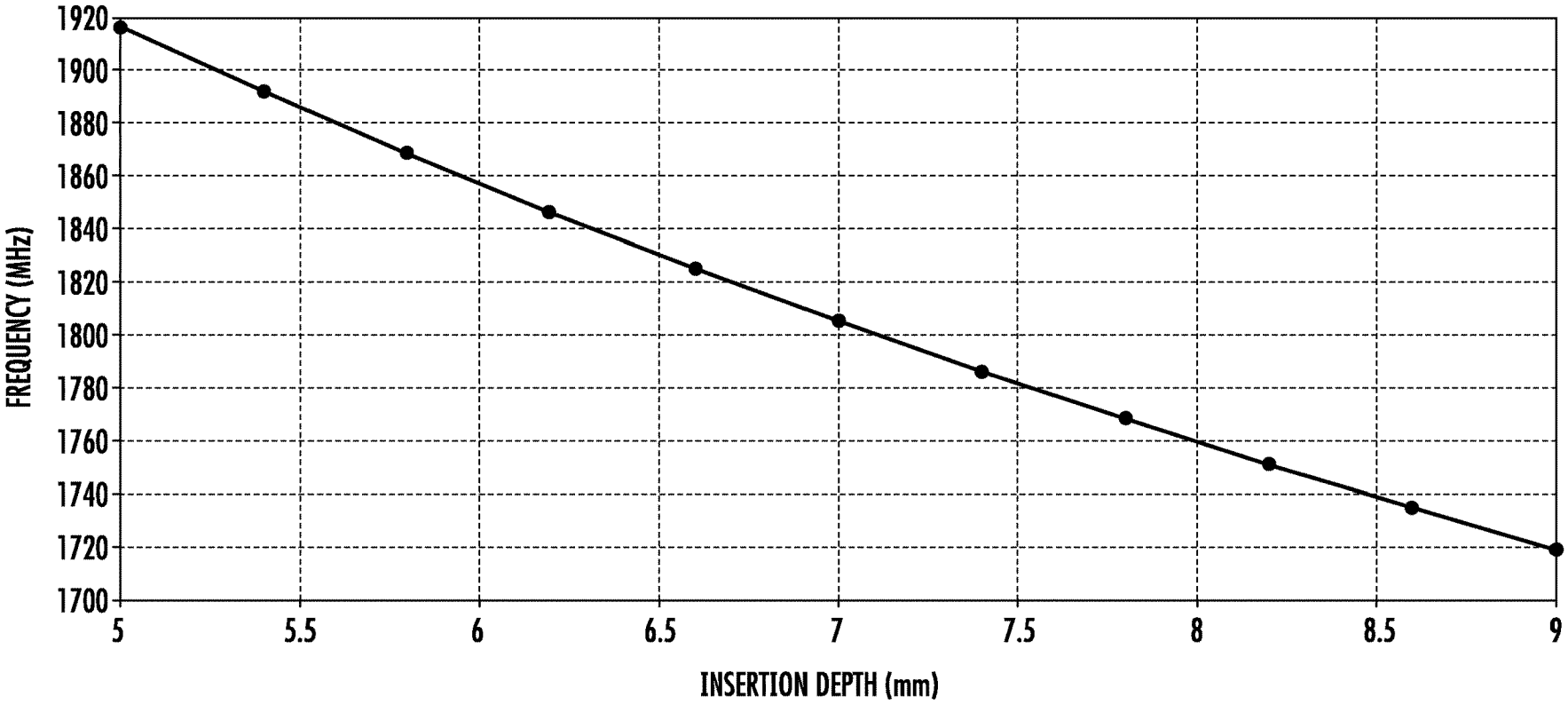
FIG. 10 is a graph illustrating the frequency tuning range of the tuning screw of FIG. 6.

FIGS. 6-10 illustrate a tuning screw 200 according to embodiments of the present invention as well as a portion of a resonant cavity filter 250 that includes the tuning screw 200. In particular, FIG. 6 is a perspective view of the tuning screw 200. FIG. 7 is a schematic cross-sectional view of the tuning screw 200 illustrating how it is received within a coaxial resonator of a resonant cavity filter 250. FIG. 8 is a broken-away, perspective view of a portion of a resonant cavity filter 250 having the tuning screw 200 inserted therein. FIG. 9 is a cross-sectional view of a portion of the filter 250. FIG. 10 is a graph illustrating the frequency tuning range of the tuning screw 200.

As shown in FIG. 6, the tuning screw 200 includes a head portion 210, a dielectric spacer 220, a metallic tuning element 230 and an insulating sheath 240.

Referring now to FIG. 7, the resonant cavity filter 250 includes a housing 260 that has a cover 262. A resonator 270 such as, for example, a metallic coaxial resonator 270 is disposed within a cavity 268 of the filter 250. The coaxial resonator 270 may have a generally cylindrical shaped sidewall 272 that defines an open interior 274. The top cover 262 includes an opening 264. An internally-threaded nut 266 is disposed above the opening 264 and may, for example, be soldered to the top cover 262 or die cast integrally with the top cover 262. In other embodiments, the internally-threaded nut 266 may comprise a threaded bushing that is formed in the top cover 262 (which may be a removable bushing or which may simply be threads formed in the sidewalls that define the opening 264). The tuning screw 200 is threadingly mated with the nut 266 so that the metallic tuning element 230 may be raised and lowered to extend different distances (or not at all) into the open interior 274 of the coaxial resonator 270 by rotating the tuning screw 200.

Referring to FIGS. 6 and 7, the head portion 210 may include a head 212. The head 212 may include one or more slots, openings, protrusions or other mating structures 214 that are designed to cooperate with a tool for purposes of rotating the tuning screw 200. In some embodiments, the head 212 may include a female mating structure 214 such as a slot that is configured to receive the end of a regular screwdriver, a pair of crossed slots that are configured to receive the end of a Phillips screwdriver, a square or hexagonal aperture that is designed to receive an end of an Allen wrench, a star shaped cavity that is configured to receive an end of a Torx tool, etc. In other embodiments, the mating structure 214 may comprise a protruding structure such as, for example, a square or hexagonal nut. In the depicted embodiment, the mating structure 214 comprises a slot.

The head portion 210 includes external threads 216 that mate with the threads of the mating nut 266. In the depicted embodiment, the external threads 216 comprise an outer portion of the head 212. In other embodiments, a shaft that is integral with the head 212 may protrude downwardly from the head 212 and the external threads 216 may be provided on the shaft.

The head portion 210 may further include an aperture 218 in lower surface thereof. In some embodiments, the aperture 218 may be internally threaded or may include annular protrusions or annular channels. In other embodiments, the aperture 218 may have smooth sidewalls. In embodiments where the head portion 210 includes a shaft the aperture 218 may be in a lower surface of the shaft. The aperture 218 may receive a protruding portion of the dielectric spacer 220, as will be discussed in further detail below.

The metallic tuning element 230 may comprise a rod such as, for example, a tubular metal shaft that is disposed below the head portion 210. The metallic tuning element 230 may have sidewalls 232 (note that in some embodiments the metallic tuning element 230 may be a metallic rod that has a cylindrical shape so that the sidewalls 232 thereof form a single continuous sidewall in some embodiments). An aperture 234 may be provided in an upper portion of the metallic tuning element 230. In some embodiments, the aperture 234 may be internally threaded or may include annular protrusions or annular channels. In other embodiments, the aperture 234 may have smooth sidewalls.

The insulating sheath 240 may comprise a tubular structure that is formed of an insulating material such as a plastic. The lower end of the tubular structure may or may not be open, although open ended tubes may be preferred in some embodiments as they may be less expensive to manufacture. The insulating sheath 240 may surround the outer sidewalls 232 of the metallic tuning element 230.

The dielectric spacer 220 may electrically insulate the metallic tuning element 230 from the metallic head portion 210. The dielectric spacer 220 may have an upper section 222, a central section 224 and a lower section 226. The upper section 224 may be received within the aperture 218 in the lower surface of the head portion 210, and the lower section 226 may be received in the aperture 234 in the upper surface of the metallic tuning element 230. The middle section 224 may connect the upper section 222 and the lower section 226. As shown in FIG. 7, the middle section 224 may have a greater cross-sectional area in a transverse plane than the upper section 222 and/or the lower section 226 in some embodiments, although this need not be the case. Herein, the longitudinal direction of a tuning screw refers to a direction that is coincident with a longitudinal axis of the metallic tuning element 230, and a transverse plane refers to a plane that extends perpendicularly to the longitudinal direction. In some embodiments, the dielectric spacer 220 may have a cruciform-shaped longitudinal cross-section, as shown in FIG. 7. If the aperture 218 is a threaded aperture, the upper section 222 may have external threads (not shown). If the aperture 218 includes annular protrusions or slots, the upper section 222 may have corresponding annular slots or protrusions so that annular protrusions on one structure mate with the annular slots on the other structure. If the aperture 218 has smooth sidewalls, the upper section 222 may have smooth sidewalls or corrugated sidewalls. The upper section 222 may be threaded into the aperture 218 or press fit into the aperture 218. The lower section 226 and the aperture 234 in the metallic tuning element 230 may likewise have any of the above-described configurations.

Turning again to FIG. 7, operation of the tuning screw 200 will be discussed. An operator may insert a tool into the mating structure 214 of the head portion 210 and rotate the tool in order to change the position of the tuning screw 200 within the mating nut 266. For instance, in an example embodiment, the tool may be used to rotate the tuning screw 200 clockwise in order to insert the turning screw 200 farther into the cavity 268 of filter 250, and the tuning screw 200 may be rotated counter-clockwise to withdraw the turning screw 200 farther out of the cavity 268 of filter 250. In this fashion, the tuning screw 200 may be inserted deep into the open interior 274 of the coaxial resonator 270 or may be withdrawn completely from the interior 274 of the coaxial resonator 270 or set to any intermediate position therebetween. Lower portions of the sidewalls 232 of the metallic tuning element 230 may capacitively couple with the inner metallic sidewall 272 of the coaxial resonator 270. Likewise, upper portions of the of the sidewalls 232 of the metallic tuning element 230 may capacitively couple with the portions of the top cover 262 that define the opening 264 (i.e., with the sidewalls of the opening 264), and, in some embodiments, may couple with the mating nut 266. As the coupling (1) between the coaxial resonator 270 and the tuning screw 200 and (2) between the tuning screw 200 and the top cover 262 is capacitive in nature, there are no metal-to-metal contacts in the coupling path that are potential sources of PIM distortion.

Additionally, the dielectric spacer 220 separates the metallic tuning element 230 from the head portion 210. The thickness of the central portion 224 of the dielectric spacer 220 may be selected so that any capacitive coupling between the metallic tuning element 230 and the head portion 210 may be at suitably low levels. As a result, the threaded head portion 210 of the tuning screw 200 may be substantially electrically isolated from the metallic tuning element 230. Consequently, even if the threaded connection between the head portion 210 and the mating nut 266 exhibits inconsistent metal-to-metal contacts, such inconsistent metal-to-metal contacts may result in little or no PIM distortion along the RF transmission path.

The tuning screw 200 may thus exhibit excellent PIM distortion performance. Additionally, as the head portion 210 of tuning screw 200 fills the opening 264 in the top cover 262, the tuning screw 200 naturally will exhibit very low levels of RF emission. The tuning screw 200 and nut 266 may be a standard screw/nut combination, or may be a self-locking tuning screw/nut combination. The provision of the insulating sheath 240 may increase the tuning range of the tuning screw 200. Additionally, the insulating sheath 240 may also act as a better dielectric than air, and hence may allow for higher power operation.

While the tuning screw 200 may provide a number of significant advantages, it also may have some limitations. For example, the coupling between the upper portion of the metallic tuning element 230 and the top cover is capacitive coupling, and the facing surfaces of the metallic tuning element 230 and the sidewalls of the opening 264 may be relatively small. This may limit the amount of capacitive coupling that may occur, which may limit the tuning range of the tuning screw 200. The tuning range may be increased by, for example, increasing the thickness of the top cover 262, but this may increase the cost and weight of the filter 250. Additionally, the mating threaded surfaces are on the inside of the nut 266 above the opening 264 in the top cover 262. When the tuning screw 200 is rotated to tune the frequency response of the filter 250, small metal shavings may be torn away from outer surfaces of the tuning screw 200 and/or from the inner surface of the internally-threaded nut 266. Such metal shavings are another well-known source of PIM distortion in RF components, and may be particularly troubling as the metal shavings can move around inside the filter 250 resulting not only in increased PIM distortion, but PIM distortion levels that can change over time in unpredictable ways. If increased PIM distortion levels are identified during a PIM distortion test during qualification of a particular unit, then the filter 250 can be opened and cleaned to remove the metal particles. However, if the metal particles are not initially detected it can be a significant problem, as PIM distortion may arise later after the filter 250 has been installed, for example, on an antenna that is mounted on a cell tower, requiring a very expensive replacement operation, downtime of the cellular base station, etc.

FIGS. 8-9 are a broken-away perspective view and a cross-sectional view, respectively, illustrating the tuning screw 200 in use in the resonant cavity filter 250.

FIG. 10 is a graph illustrating the simulated frequency tuning range of the tuning screw of FIG. 6. For purposes of the simulation, the cavity 268 was a 47×47 mm cavity with a height of 46 mm, and the resonator 270 was assumed to have a diameter of 15 mm and a height of 44 mm. In this example, it was assumed that the tuning screw 200 would travel a total of 4 mm when moving between its fully inserted to its fully extracted positions. In other words, the change in depth of the tuning screw 200 between its fully extracted and fully inserted positions is 4 mm. This travel distance may also be referred to herein as the "stroke" of the tuning screw 200. As shown in FIG. 10, the tuning screw 200 may be used to tune the resonant frequency between about 1720-1920 MHz. Simulations also show that there is little to no transition of current to the threaded connection between the tuning screw 200 and its mating nut 266.

As discussed above, one potential disadvantage of the tuning screw 200 is that the threaded connection between the tuning screw 200 and its mating nut 266 is directly above the opening 264 in the top cover 262, which may allow metal shavings to fall within the cavity 268 of filter 250. Pursuant to further embodiments of the present invention, tuning screws are provided that have threads that mate with threads that are on the outside of a mating nut, which may reduce or prevent metal shavings or debris that may be generated when a tuning screw is rotated within a mating nut from falling into the interior of the filter.

Figure 11:
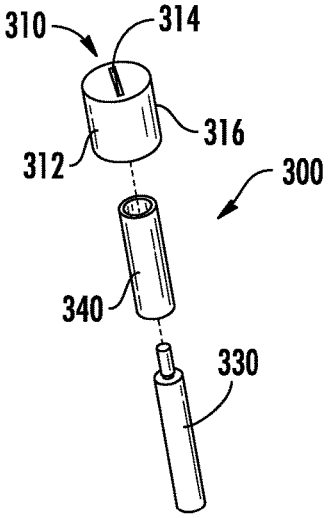
FIG. 11 is a perspective view of a tuning screw according to further embodiments of the present invention.
Figure 12:
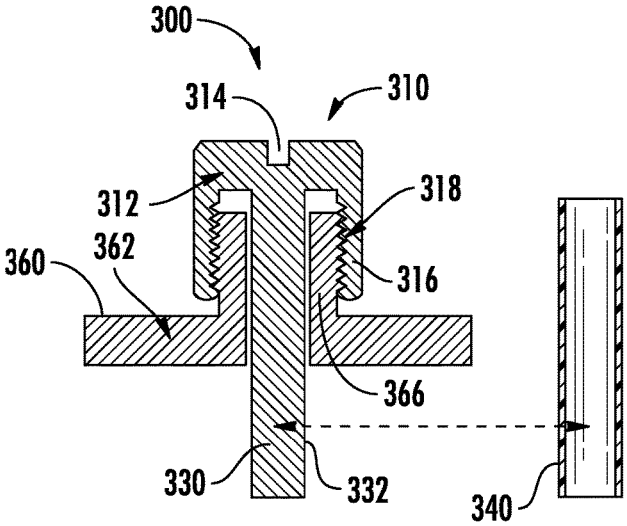
FIG. 12 is a schematic cross-sectional view of the tuning screw of FIG. 11 inserted into a nut in a top cover of a resonant cavity filter.
Figure 13A:
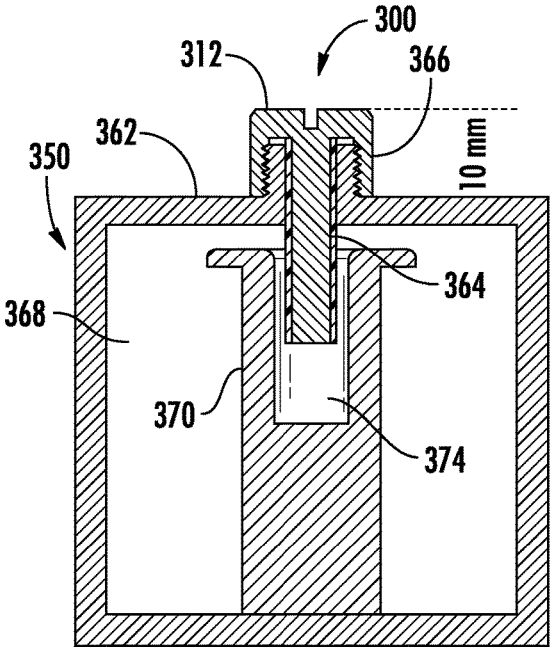
FIGS. 13A-13B are schematic cross-sectional views of the tuning screw of FIG. 11 inserted at different depths into a coaxial resonator of a resonant cavity filter.
Figure 13B:
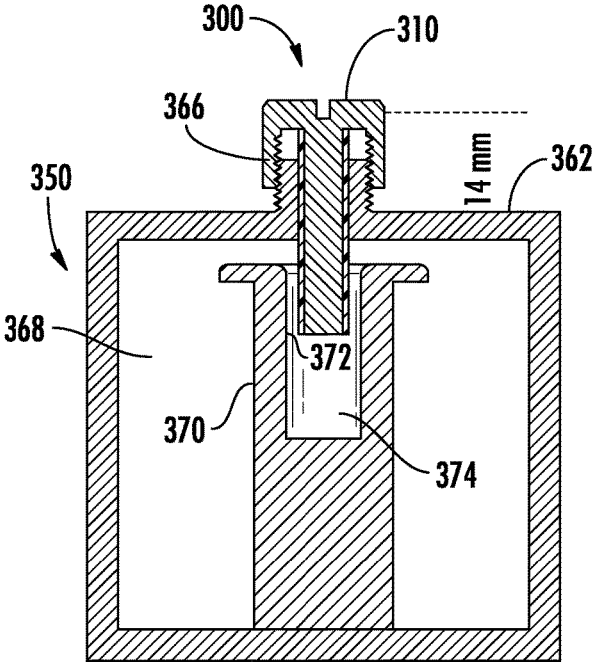
Figure 14:
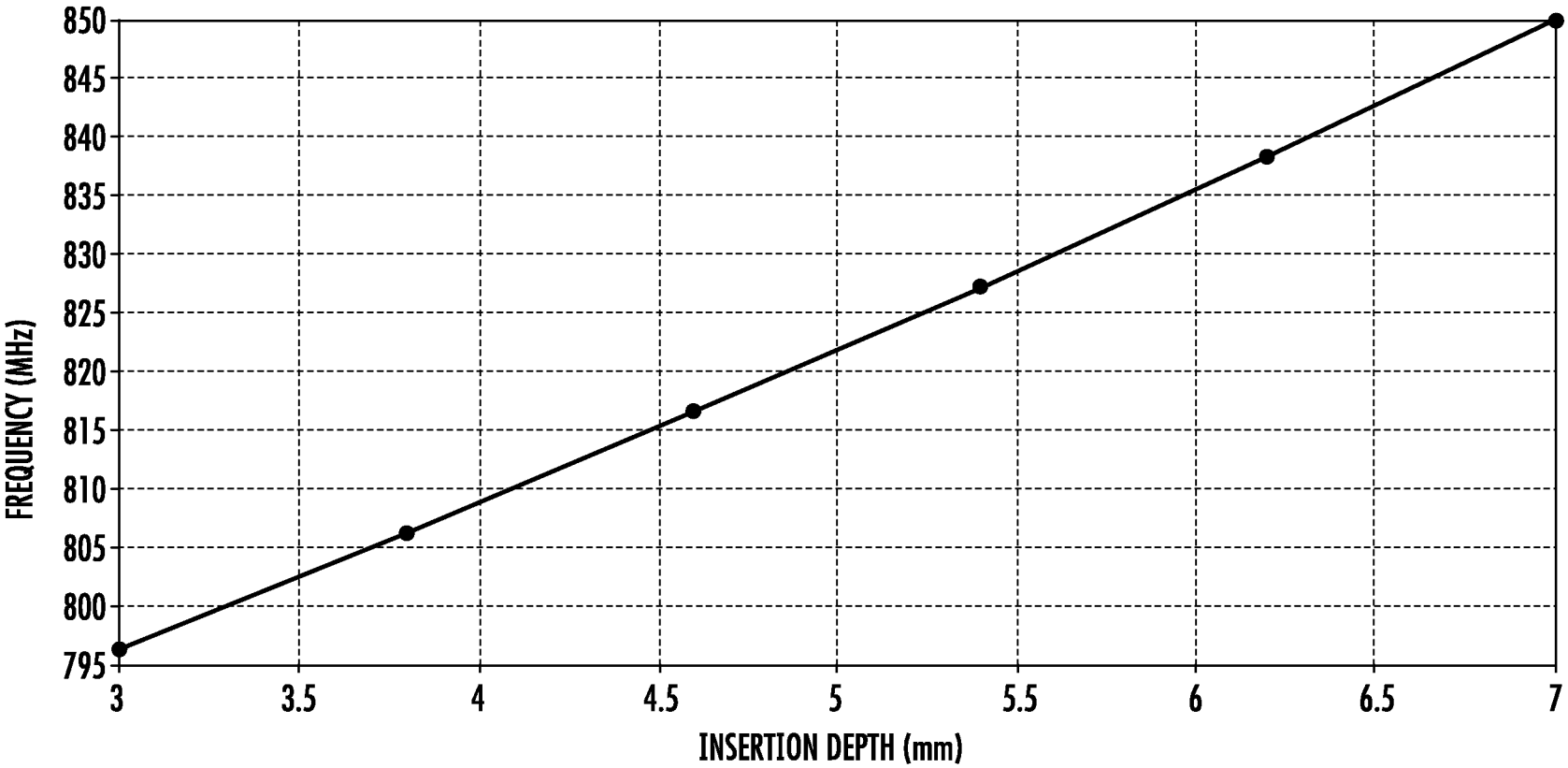
FIG. 14 is a graph illustrating the frequency tuning range of the tuning screw of FIG. 11.

FIG. 11 is a perspective view of a tuning screw 300 for a resonant cavity filter 350 that may reduce or prevent metal shavings or debris from falling within the interior of the filter. FIG. 12 is a cross-sectional view of the tuning screw 300 inserted into a mating nut in a top cover of the resonant cavity filter 350. FIGS. 13A-13B are schematic cross-sectional views of the tuning screw 300 inserted at different depths into a coaxial resonator of the filter 350. FIG. 14 is a graph illustrating the frequency tuning range of the tuning screw 300.

As shown in FIGS. 11-12, the tuning screw 300 includes a head portion 310, a metallic tuning element 330 and an insulating sheath 340. The head portion 310 may include a head 312. A top surface of the head 312 may include one or more slots or other mating structures 314 that are designed to cooperate with a tool for purposes of rotating the tuning screw 300, as is described above with reference to the tuning screw 200. A cylindrical flange 316 extends downwardly from the head 312. The flange 316 has a plurality of internal threads 318 that mate with external threads of a mating nut, as will be described in further detail below.

The metallic tuning element 330 may comprise a tubular metal shaft that extends downwardly from a lower surface of the head 312. The metallic tuning element 330 may have sidewalls 332. The insulating sheath 340 may comprise a tubular structure that is formed of an insulating material such as a plastic. The lower end of the insulating sheath 340 may or may not be open. The insulating sheath 340 may surround the outer sidewall(s) 332 of the metallic tuning element 330. In an example embodiment, the metallic tuning element 330 may be a rod having a diameter of 4 mm and the insulating sheath 340 may be a tube having a diameter of 5 mm and an open interior so that the tube may be slid into the metallic tuning element 340.

Operation of the tuning screw 300 can best be seen with reference to FIGS. 12 and 13A-13B. As shown in FIG. 12, figure, a resonant cavity filter 350 includes a housing 360 that has a top cover 362. A resonator 370 such as, for example, a metallic coaxial resonator 370 is disposed within a cavity 368 of the housing 360. The coaxial resonator 370 may have a generally cylindrical shaped sidewall 372 that defines an open interior 374.

The top cover 362 includes an opening 364. An externally-threaded nut 366 is disposed in and/or above the opening 364. The metallic tuning element 330 of tuning screw 300 may be inserted into the opening 364 in the top cover 362 of filter 350. The internal threads 318 of head portion 310 may mate with the external threads of the nut 366. As with the tuning screw 200, lower portions of the sidewalls 332 of the metallic tuning element 330 may capacitively couple with the inner metallic sidewall 372 of the coaxial resonator 370.

As the threaded connection between the internal threads 318 and the external threads of the nut 366 is along the outside of the nut 366, any metal shavings that are generated when the tuning screw 300 is mated with the nut 366 should not fall within the opening 364 as the nut 366 is between the location where any such metal shavings will be generated and the opening 364. Accordingly, PIM distortion performance may be improved. Additionally, as the head portion 310 of tuning screw 300 fills the opening 364, the tuning screw 300 naturally will exhibit very low levels of RF emission. The tuning screw 300 may also exhibit increased capacitive coupling between the upper portion of the metallic tuning element 330 and the top cover 362 as compared to tuning screw 200, as the interior of the nut 366 provides a larger capacitive coupling surface. Moreover, the amount of this capacitive coupling may be constant regardless of how far the tuning screw 300 is inserted within the filter 350.

The tuning screw 300 does not include a dielectric spacer similar to the dielectric spacer 220 included in tuning screw 200. However, as the galvanic contact between the threads 318 of tuning screw 300 and the external threads of nut 366 are well outside of the cavity 368 of filter 350, the currents on this threaded connection may be relatively low, and hence may not be a major source of PIM distortion. As will be discussed below, in other embodiments, the tuning screw 300 may be modified to include a dielectric spacer in order to further improve the PIM distortion performance thereof.

FIGS. 13A-13B are schematic cross-sectional views of the tuning screw 300 inserted at different depths into a coaxial resonator 370 of a resonant cavity filter 350.

FIG. 14 is a graph illustrating the frequency tuning range of the tuning screw 300. In this particular example, the tuning screw 300 has a stroke of 4 mm. As shown in FIG. 14, the tuning screw 300 may be used to tune the resonant frequency between about 795-850 MHz.

Figure 15:
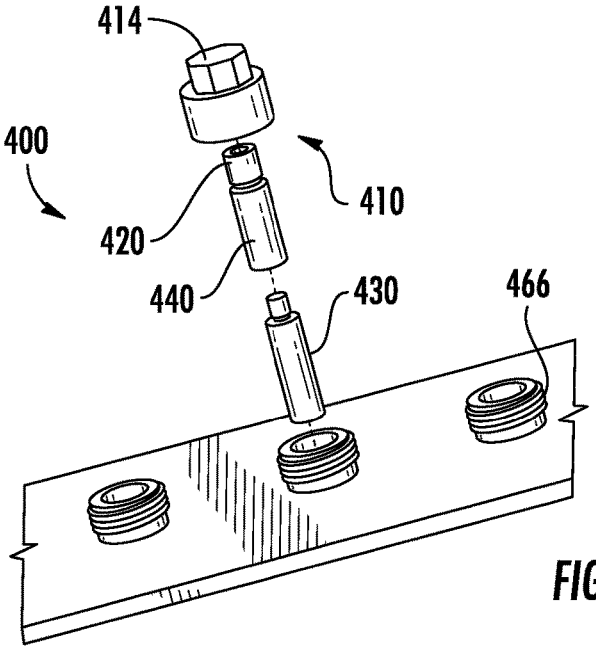
FIG. 15 is a perspective view of a tuning screw according to still further embodiments of the present invention positioned above a mating nut formed in a top cover of a resonant cavity filter.
Figure 16:
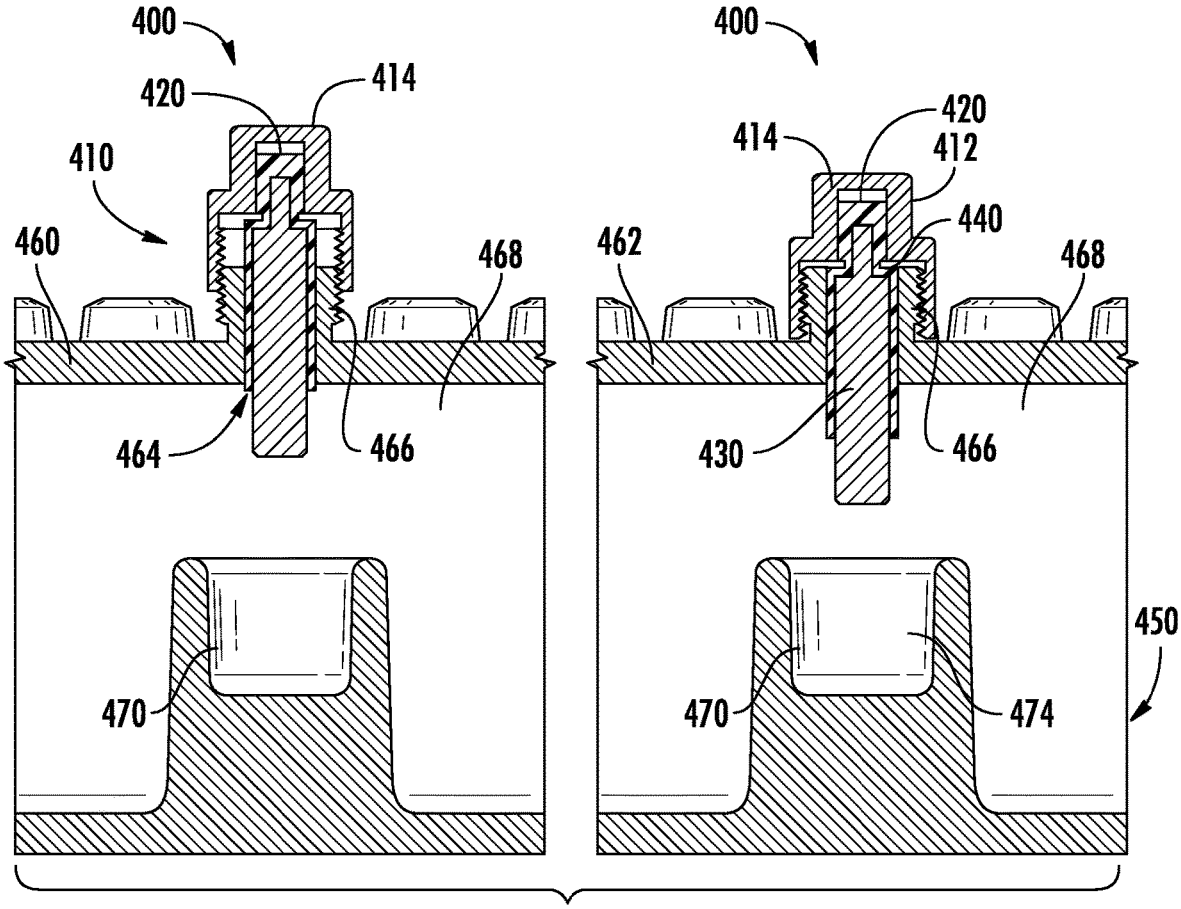
FIG. 16 is a pair of cross-sectional views of the tuning screw of FIG. 15 inserted into a nut in a top cover of a resonant cavity filter with the tuning screw shown at two respective depths within the filter.

FIG. 15 is a perspective view of a tuning screw 400 according to still further embodiments of the present invention. FIG. 16 is a pair of cross-sectional views of the tuning screw 400 threadingly mated with a nut in a top cover of a resonant cavity filter 450. The left view in FIG. 16 illustrates the tuning screw 400 when it is almost in its fully withdrawn position while the right side view in FIG. 16 illustrates the tuning screw 400 in its fully inserted position within the filter 450.

As shown in FIGS. 15-16, the tuning screw 400 is very similar to the tuning screw 300 and, like tuning screw 300, includes a head portion 410 having a head 412 a metallic tuning element 430 and an insulating sheath 440. As these components of tuning screw 400 may be structurally and functionally similar to the corresponding elements of tuning screw 300, only differences between these elements and the corresponding elements of tuning screw 300 will be described below. The tuning screw 400 further includes a dielectric spacer 420. The dielectric spacer 420 is provided between the head 412 and the metallic tuning element 430. The dielectric spacer 420 may electrically isolate the head portion 410 from the metallic tuning element 430. As shown in FIG. 15, the dielectric spacer 420 and the insulating sheath 440 may be formed as a single monolithic element in some embodiments. While not shown in FIGS. 15-16, in some embodiments the dielectric spacer 420 may be replaced with the dielectric spacer 220 included in tuning screw 200. In such embodiments, the head portion 410 and the metallic tuning element 430 may include apertures similar or identical to the apertures 218 and 234 in the head portion 210 and metallic tuning element 230, respectively, of tuning screw 200. The metallic tuning element 430 may be inserted into an externally-threaded nut 466 that is formed in or attached to a top cover 462 of a housing 460 of the filter 450. The tuning screw 400 may be received at different depths inside the open interior 474 of a coaxial resonator 470 that is mounted inside a cavity 468 of the resonant cavity filter 450.

The tuning screw 400 combines features of the tuning screws 200 and 300 that are described above. For example, the tuning screw 400 capacitively couples with both the coaxial resonator 470 and the top cover 462, and consequently there are no metal-to-metal contacts in the coupling path that are potential sources of PIM distortion. Additionally, the dielectric spacer 420 separates the metallic tuning element 430 from the head portion 410, and thus the threaded head portion 410 may be substantially electrically isolated from the metallic tuning element 430 so that the threaded connection between the head portion 410 and the nut 466 is isolated from the RF transmission path. Moreover, since this threaded connection is not above the opening 464 in the top cover 462, metal debris that may be generated when the tuning screw 400 is rotated should not fall within the cavity 468. As such, use of the tuning screws 400 should result in little or no PIM distortion generation. Furthermore, the head portion 410 fills the opening 464 so that the tuning screw 400 will naturally exhibit very low levels of RF emission. Finally, the tuning screw 400 may exhibit increased capacitive coupling between the upper portion of the metallic tuning element 430 and the top cover 462 due to the larger metallic facing surfaces, and the amount of this capacitive coupling may be constant regardless of how far the tuning screw 400 is inserted within the filter 450.

Figure 17:
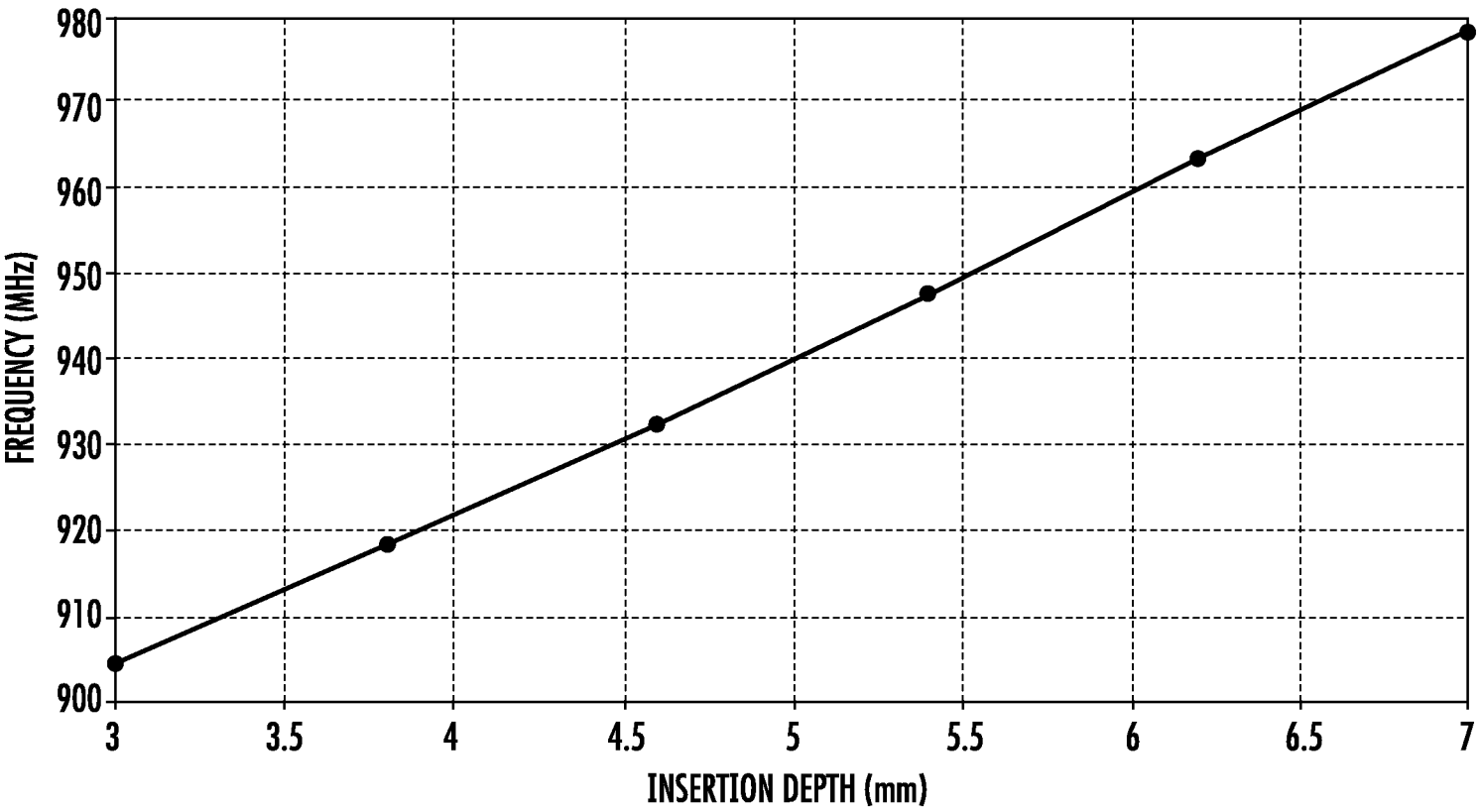
FIG. 17 is a graph illustrating the frequency tuning range of the tuning screw of FIG. 15.

FIG. 17 is a graph illustrating the frequency tuning range of the tuning screw 400. In this particular example, the tuning screw 400 has a stroke of 4 mm. As shown in FIG. 17, the tuning screw 400 may be used to tune the resonant frequency between about 905-980 MHz.

Figure 18:
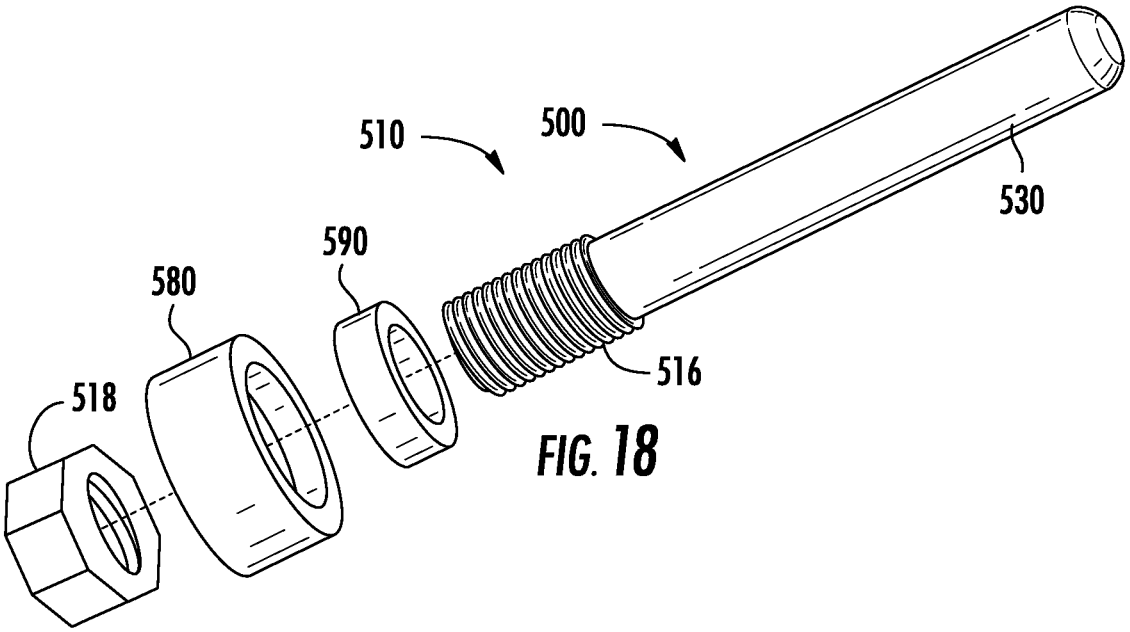
FIG. 18 is a perspective view of a tuning screw according to additional embodiments of the present invention.
Figure 19:
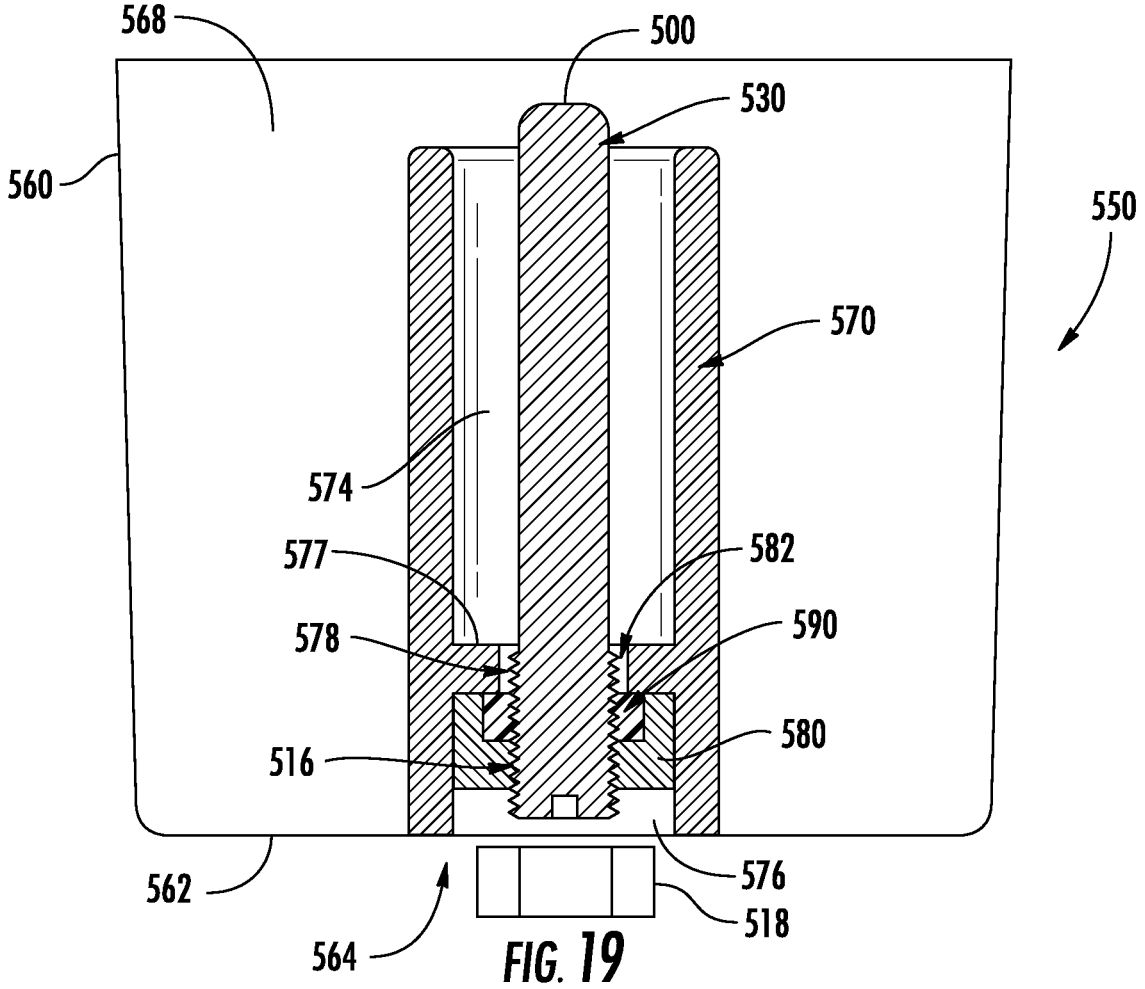
FIG. 19 is a cross-sectional view of the tuning screw of FIG. 18 inserted into a resonator of a resonant cavity filter.

FIG. 18 is a perspective view of a tuning screw 500 according to additional embodiments of the present invention. FIG. 19 is a cross-sectional view of the tuning screw 500 inserted into a resonator 570 of a resonant cavity filter 550. The tuning screw 500 extends into the interior of the filter housing 560 from the bottom 562 of the filter 550, as will be described in more detail below.

Referring first to FIG. 18, the tuning screw 500 includes a head portion 510 and a metallic tuning element 530 which may be in the form of a metallic rod that extends upwardly from the head portion 510. The metallic tuning element 530 that is externally threaded at or near a lower end thereof. The upper portion of the tuning element 530 is not threaded, although it may be in some embodiments. In some embodiments, the tuning screw 500 may comprise a monolithic bolt having a head portion 510 that comprises an expanded head and a shaft extending therefrom having external threads 516. In such embodiments, the metallic tuning element 530 may comprise an extension of the shaft. As shown in FIG. 18, in other embodiments, the tuning screw 500 may comprise a two piece unit where the head is in the form of a nut 518 that is separate from the remainder of the tuning screw 500. Only the portion of the metallic rod 530 that is adjacent the head portion 510 may be threaded. The head portion 510 may also include a one or more slots, openings, protrusions or other mating structures 514 that may mate with a corresponding tool that allows a user to rotate the tuning screw 500. An insulative sheath (not shown) similar to the insulative sheath 240 discussed above may also be provided that fits over the metallic tuning element 530.

Turning now to FIG. 19, it can be seen that the tuning screw 500 is inserted coaxially into the interior 574 of a coaxial resonator 570 of the resonant cavity filter 550. The tuning screw 500 is inserted into the coaxial resonator 570 from the bottom as opposed to from the top as was the case with tuning screws 200, 300 and 400 that are described above. A metallic nut 580 in the form of a bushing, which may be threaded, may be used to hold the tuning screw 500 in place. The threaded metallic bushing 580 has an internally-threaded aperture running therethrough that receives the tuning screw 500, and is also externally threaded.

The filter 550 includes a housing 560 having a bottom wall 562. The metallic bushing 580 is received through an opening 564 in the bottom wall 562 within a cylindrical cavity 576 that is provided in the lower portion of the coaxial resonator 570. The cavity 576 is separated from the upper portion of the interior 574 of the coaxial resonator by an inwardly protruding flange 577. The flange 577 is sized so that an annular air gap 578 is provided between the flange and the tuning element 530. The cavity 576 includes internal threads that mate with the external threads of the bushing 580 to facilitate mounting the bushing 580 in the cavity 576. In other embodiments, the bushing 580 may be press fit in the cavity 576 or attached via other mechanisms (e.g., soldering). The nut 518 may also be inserted into the cavity 576. The nut 518 may serve as a lock nut for the remainder of the tuning screw 500. The threaded metallic bushing 580 and/or the nut 518 may hold the tuning screw 500 in place within the coaxial resonator 570 and the internal threads thereof may provide a mechanism that allows the distance that the tuning screw 500 extends into the coaxial resonator 570 to be adjusted. The metallic bushing 580 includes an annular recess 582 in an upper portion of the sidewalls thereof. A dielectric stopper 590 is received within this annular recess 582. The dielectric stopper 590 may comprise, for example, an O-ring, a nut (which may or may not be internally threaded) or the like. The dielectric stopper 590 may reduce or prevent metal shavings or debris that may be generated when the tuning screw 500 is rotated within the metallic bushing 580 from falling into the cavity 568 (note that the filter 550 may be mounted on its side or even upside down so that a real potential for metal shavings to fall within the cavity 568 exists). The tuning screws 500 may allow for filters having a smaller overall footprint.

Figure 20:
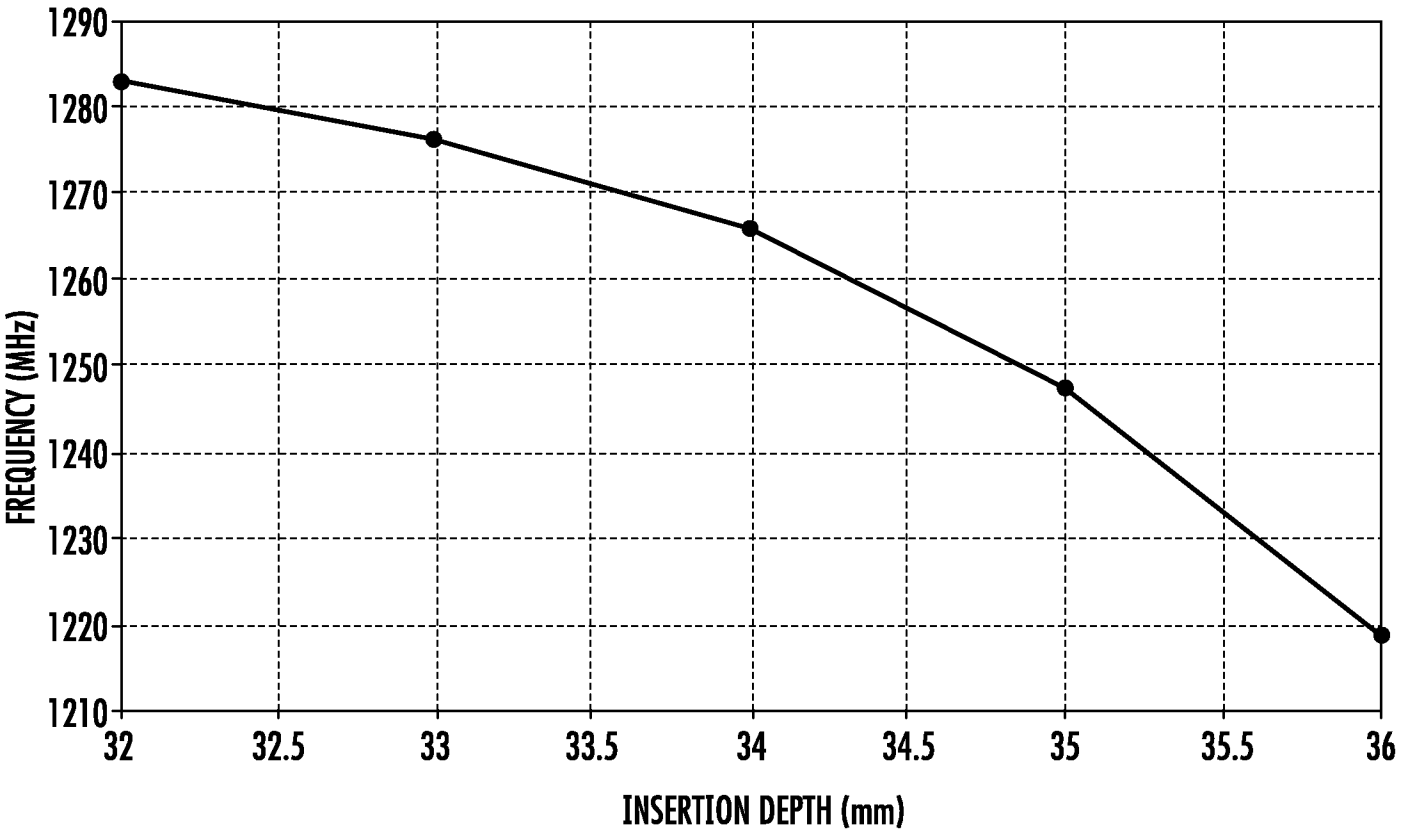
FIG. 20 is a graph illustrating the frequency tuning range of the tuning screw of FIG. 18.

FIG. 20 is a graph illustrating the frequency tuning range of the tuning screw 500. In this particular example, the tuning screw 500 has a stroke of 4 mm. As shown in FIG. 20, the tuning screw 500 may be used to tune the resonant frequency between about 1220-1285 MHz.

Figure 21:
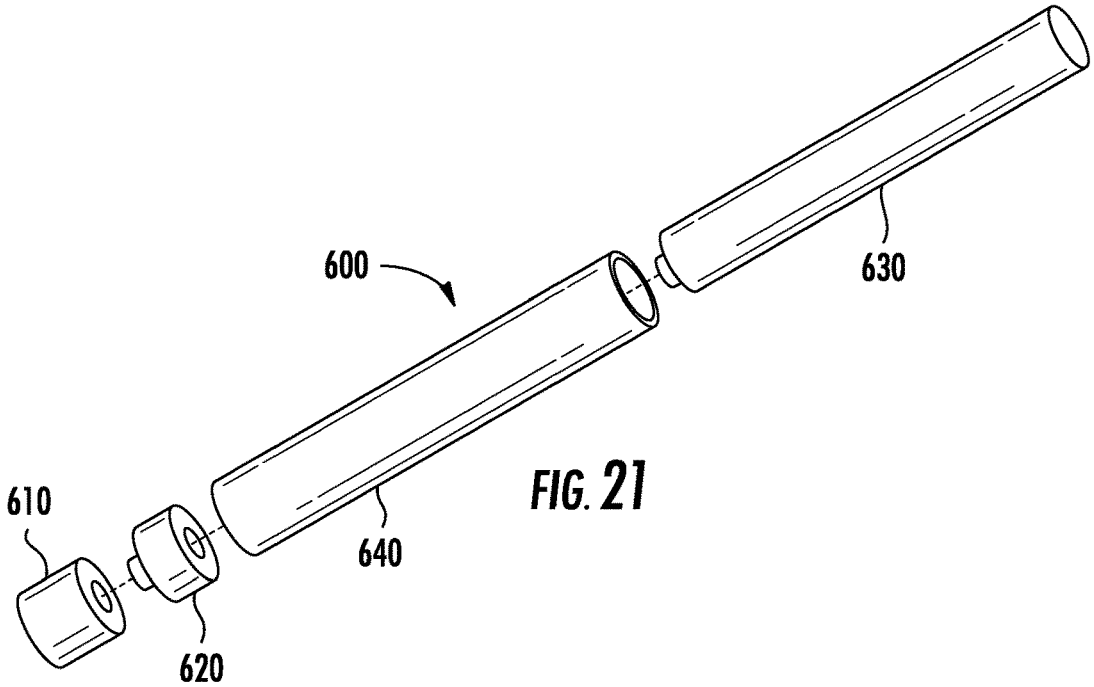
FIG. 21 is a perspective view of a tuning screw according to yet additional embodiments of the present invention.
Figure 22:
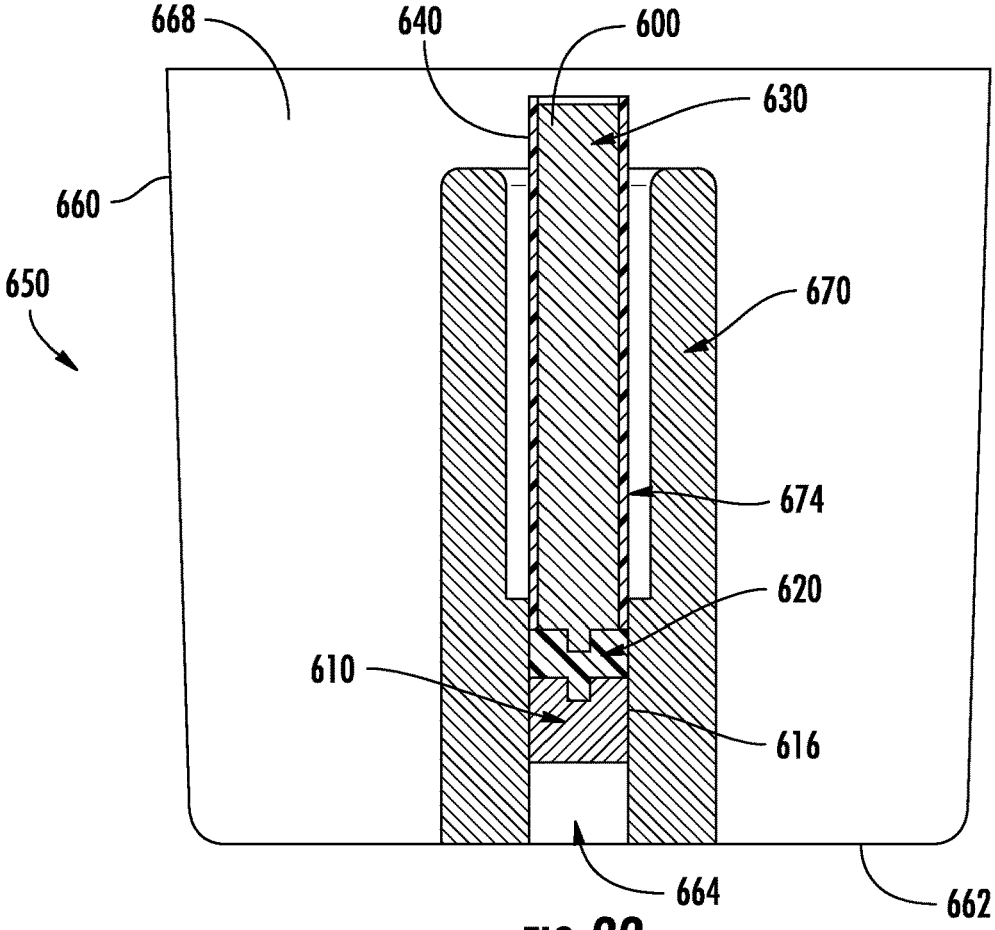
FIG. 22 is a cross-sectional view of the tuning screw of FIG. 21 inserted into a resonator of a resonant cavity filter.
Figure 23:
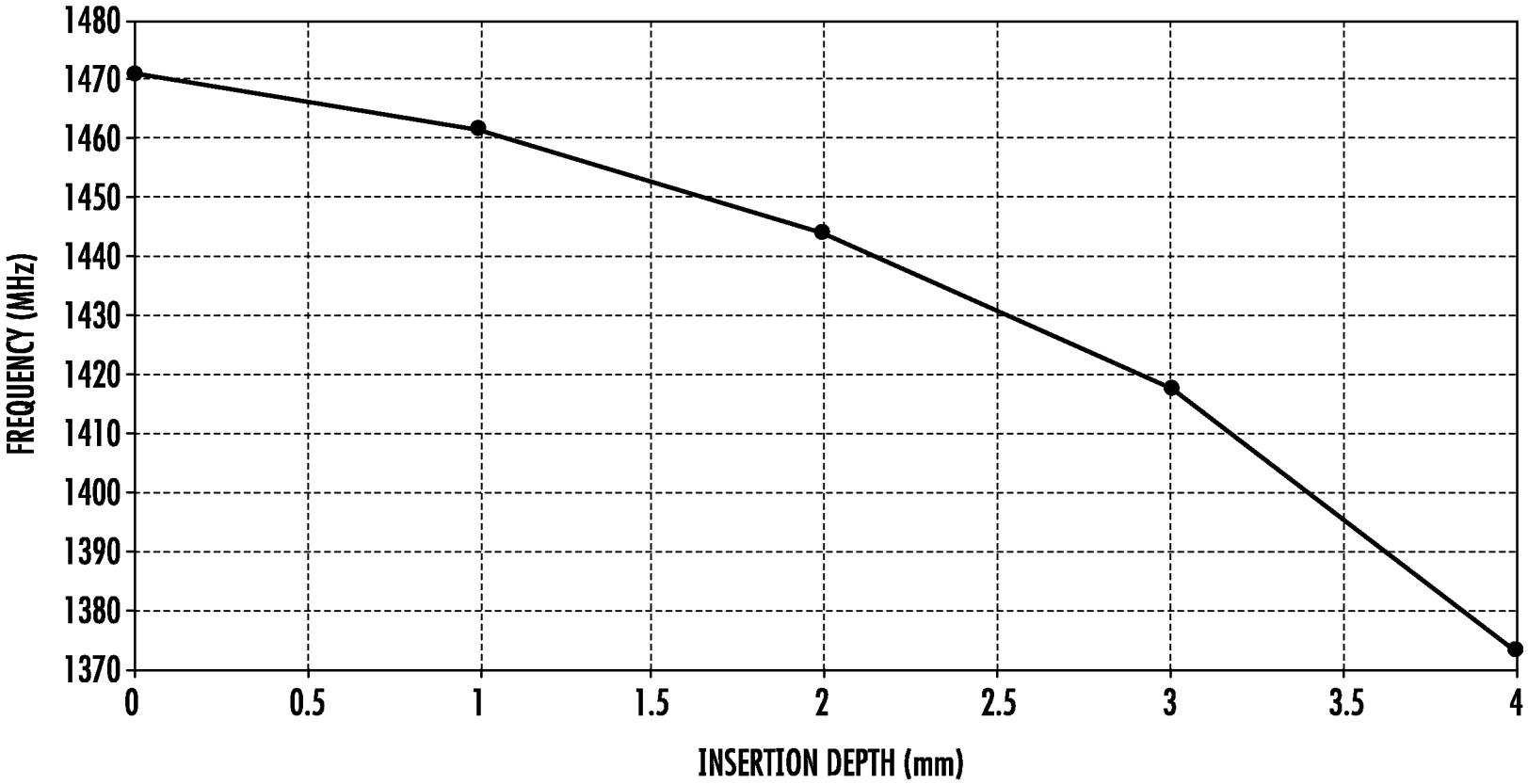
FIG. 23 is a graph illustrating the frequency tuning range of the tuning screw of FIG. 21.

FIG. 21 is a perspective view of a tuning screw 600 according to yet additional embodiments of the present invention. FIG. 22 is a cross-sectional view of the tuning screw 600 of FIG. 21 inserted into a resonator 670 of a resonant cavity filter 650. FIG. 23 is a graph illustrating the frequency tuning range of the tuning screw 600.

The filter 650 includes a housing 660 having a bottom surface 662. The resonator 670 extends upwardly from the bottom surface 662 into a cavity 668. An opening 664 is provided in the bottom surface 662 underneath the resonator 670. The tuning screw 600 is inserted into the open interior 674 of the coaxial radiator 670 through the opening 664. As the tuning screw 600 fills the opening 664, little or no RF emission will occur through the opening 664.

The tuning screw 600 is similar to the tuning screw 500 that is discussed above. The tuning screw 600, however, further includes a dielectric spacer 620 that separates the head portion 610 of tuning screw 600 from the metallic tuning element 630 thereof. The dielectric spacer 620 may electrically isolate the threaded connection between the tuning screw 600 and the housing 660 of the filter 650 from the RF transmission path, and hence may improve PIM distortion performance. In some embodiments, the dielectric spacer 620 may have the design of the dielectric spacer 220 of tuning screw 200. In the particular embodiment depicted in FIGS. 21-22, the head portion 610 of tuning screw 600 has the same diameter as the metallic tuning element 630. External threads 616 are provided on the head portion 610 that mate with internal threads provided in the bottom of the coaxial resonator 670. An insulating sleeve 640 is provided that fits over the tuning element 630. The tuning screw 600 may also be implemented as a self-locking tuning screw.

The resonant cavity filters and associated tuning screws according to embodiments of the present invention may provide a number of advantages over conventional filters and tuning screws. For example, in some embodiments, the threaded head portions of the tuning screws may be electrically isolated from the metallic tuning elements. This may ensure that the amount of current on the threaded connection between the tuning screws and their mating nuts is very low, as only capacitively coupled currents are present. This may significantly reduce the generation of PIM distortion at these threaded connections that can impact the performance of the filter. Additionally, in some embodiments, the threaded connection between the tuning screw and its mating nut may be provided to be remote from the opening in the filter housing for the tuning screw. This may significantly reduce the possibility that metal shavings can fall into the interior of the filter that may be generated when the tuning screw is rotated for tuning purposes. Moreover, in some embodiments, a dielectric stopper may be provided that may also reduce the possibility that such metal shavings may fall into the interior of the filter.

It should also be noted that in addition to PIM distortion, inconsistent metal-to-metal connections may give rise to reflections in an RF communications system, which increase the return loss along the RF transmission path. Accordingly, devices that have such inconsistent metal-to-metal connections may therefore exhibit increased insertion loss values. By designing filters and tuning screws to have the threaded connections between the tuning screws and the filter housing outside of the RF transmission path, the filters according to embodiments of the present invention may exhibit improved insertion loss performance.

In some embodiments depicted in the figures, the nuts that mate with the respective tuning screws are shown in the form of separate nuts that are soldered to the exterior surface of the filter housing and/or as bushings that are mounted in the respective openings through the filter housings. It will be appreciated that other implementations are possible. As one example, nuts may be soldered to the interior of the filter housing and coaxially aligned with the respective openings therein. As another example, thicker housing pieces may be used that have threads formed in the sidewalls of the openings therein (i.e., an integral bushing) as opposed to using separate bushings as shown in some embodiments. Other implementations are possible.

It will be appreciated that the filters according to embodiments of the present invention may be used to implement a wide variety of different devices including duplexers, diplexers, multiplexers, combiners and the like. It will be appreciated that the filters according to embodiments of the present invention may also be used in applications other than cellular communications systems.

While various embodiments of the present invention have been described above, it will be appreciated that these embodiments may be changed in many ways without departing from the scope of the present invention, which is detailed in the appended claims. It will also be appreciated that the various embodiments disclosed herein may be combined in any way to create additional embodiments, all of which are within the scope of the present invention. For example, any of the embodiments disclosed herein may have any of the disclosed dielectric spacer designs. As another example, any of the embodiments may include the dielectric stopper 590 of tuning screw 500.

The present invention has been described above with reference to the accompanying drawings, in which certain embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A resonant cavity filter comprising:

a housing having a top cover and an internal cavity;

a resonator mounted within the internal cavity extending upwardly toward the top cover from a floor of the internal cavity;

an internally-threaded member above an opening in the top cover; and a tuning screw that comprises a head portion, a metallic tuning element and a dielectric spacer interposed between the head portion and the metallic tuning element, the tuning screw received within the internally-threaded member and extending through the opening in the top cover into the internal cavity, and wherein the tuning screw is mounted for coaxial insertion into an interior of the resonator to adjust a frequency response of the resonant cavity filter and is further configured to capacitively couple with sidewalls of the top cover.

2. The resonant cavity filter of claim 1, wherein the head portion includes external threads, and the internally-threaded member is a nut or a bushing.

3. The resonant cavity filter of claim 1, further comprising an insulative sheath that is mounted on one or more sidewalls of the metallic tuning element, wherein the insulative sheath extends into the opening in the top cover.

4. The resonant cavity filter of claim 1, wherein the filter is configured so that an amount of the capacitive coupling between an upper portion of the metallic tuning element and the top cover is constant regardless of how far the tuning screw is inserted within the internal cavity.

5. A resonant cavity filter comprising:

a housing having a resonator mounted therein;

a tuning screw that comprises a head portion, a metallic tuning element and a dielectric spacer interposed between the head portion and the metallic tuning element, wherein the tuning screw is mounted for coaxial insertion into an interior of the resonator to adjust a frequency response of the resonant cavity filter, wherein the head portion includes a head and a circular flange extending downwardly from the head, and wherein the circular flange includes threads on an interior surface thereof.

6. The resonant cavity filter of claim 5, wherein the dielectric spacer comprises a central portion, a lower portion that extends downwardly from the central portion and an upper section that extends upwardly from the central portion.

7. The resonant cavity filter of claim 6, wherein the upper portion is at least partially inserted into an aperture in a lower surface of the head portion.

8. The resonant cavity filter of claim 7, wherein an area of a transverse cross-section of the central portion exceeds an area of a transverse cross-section of the upper portion.

9. The resonant cavity filter of claim 7, wherein the lower portion is at least partially inserted into an aperture in an upper surface of the metallic tuning element.

10. The resonant cavity filter of claim 9, wherein an area of a transverse cross-section of the central portion exceeds an area of a transverse cross-section of the lower portion.

11. The resonant cavity filter of claim 5, wherein an externally-threaded nut is provided in or on a top cover of the housing, and wherein the threads on the interior surface of the circular flange are configured to mate with the externally-threaded nut.

12. The resonant cavity filter of claim 11, wherein the externally-threaded nut has a smooth interior sidewall, and wherein the metallic tuning element is configured to capacitively couple with the internal sidewall of the externally-threaded net.

13. A resonant cavity filter comprising:

a housing having a resonator mounted therein, the housing having a top cover with an opening therein and an externally threaded nut mounted above, below or in the opening; and a tuning screw that comprises a head portion and a metallic tuning element mounted in the opening, wherein the head portion of the tuning screw includes internal threads, wherein the head portion includes a head and a circular flange extending downwardly from the head, and wherein the internal threads are on an inner surface of the circular flange.

14. The resonant cavity filter of claim 13, the tuning screw further comprising a dielectric spacer interposed between the head portion and the metallic tuning element.

15. The resonant cavity filter of claim 14, wherein the dielectric spacer comprises a central portion, a lower portion that extends downwardly from the central portion and an upper section that extends upwardly from the central portion.

16. The resonant cavity filter of claim 15, wherein the upper portion is at least partially inserted into an aperture in a lower surface of the head portion, and the lower portion is at least partially inserted into an aperture in an upper surface of the metallic tuning element.

17. The resonant cavity filter of claim 16, wherein an area of a transverse cross-section of the central portion exceeds an area of a transverse cross-section of the upper portion, and wherein the area of the transverse cross-section of the central portion exceeds an area of a transverse cross-section of the lower portion.

18. A resonant cavity filter comprising:

a housing having a resonator mounted therein, the housing having a bottom with an opening therein underneath the resonator;

a bushing having a central aperture mounted in the opening, the bushing having both external and internal threads, the bushing further including an annular recess in an upper surface thereof;

a tuning screw that is received within the central aperture of the bushing; and a dielectric stopper received within the annular recess in the bushing, wherein the resonator includes an internally-extending flange in a bottom portion thereof, and wherein the dielectric stopper is mounted directly below the internally-extending flange.

19. The resonant cavity filter of claim 18, wherein the dielectric stopper includes a central aperture, and wherein the tuning screw extends through the central aperture of the dielectric stopper.

20. The resonant cavity filter of claim 18, wherein the tuning screw includes a metallic tuning element that extends into an interior cavity of the resonator, and an insulative sheath that is mounted on an exterior of the metallic tuning element, and the dielectric stopper and the insulative sheath are formed as a monolithic element.

* * * * *